US005625186A

United States Patent [19]

Frankevich et al.

[11] Patent Number: 5,625,186

[45] Date of Patent: Apr. 29, 1997

[54] NON-DESTRUCTIVE ION TRAP MASS SPECTROMETER AND METHOD

[75] Inventors: Vladimir E. Frankevich; Manish H. Soni; Mario Nappi; Robert E. Santini; Jonathan W. Amy; Robert G. Cooks, all of West Lafayette, Ind.

[73] Assignee: Purdue Research Foundation, West Lafayette, Ind.

[21] Appl. No.: 620,035

[22] Filed: Mar. 21, 1996

[51] Int. Cl.[6] ..... H01J 49/42

[52] U.S. Cl. ..... 250/292; 250/291; 250/282

[58] Field of Search ..... 250/292, 291, 250/290, 282

[56] References Cited

U.S. PATENT DOCUMENTS

| | | | |
|---|---|---|---|
| 4,755,670 | 7/1988 | Syka | 250/292 |
| 4,874,943 | 10/1989 | Spencer | 250/291 |
| 4,990,856 | 2/1991 | Anderson | 324/464 |
| 5,105,081 | 4/1992 | Kelley | 250/282 |
| 5,468,958 | 11/1995 | Franzen | 250/292 |

OTHER PUBLICATIONS

Syka, et al., A Fourier Transform Quadrupole Ion Trap Mass Spectrometer, proceedings of the 35th ASMS conference, Denver, May 1987, pp. 767–768.

Parks, et al., Cluster experiments in radio frequency Paul Traps: Collisional relaxation and dissociation, J. Chem. Phys., vol. 101, No. 8, Oct. 1994, pp. 6666–6678.

Goeringer, et al., Ion Remeasurement in the Radio Frequency Quadrupole Ion Trap, Analytical Chemistry, vol. 67, No. 22, Nov. 1995, pp. 4164–4169.

Castro, et al., Field–Corrected Ion Cell for Ion Cyclotron Resonance, Analytical Chemistry, vol. 62, No. 5, Mar. 1990, pp. 520–525.

Comisarow, Signal modeling for ion cyclotron resonance, J. Chem. Phys., vol. 69, No. 9, Nov. 1978, pp. 4097–4104.

Dawson, Quadrupole Mass Spectrometry and its Applications, Elsevier Scientific Publishing Co., New York, 1976, pp. 49–52 and 134–190.

Price, et al., Dynamic Mass Spectrometry, vol. 4, pp. 39, 77, 78, and 81.

March, et al., Quadrupole Storage Mass Spectrometry, New York, Table of Contents.

*Primary Examiner*—Jack I. Berman

*Attorney, Agent, or Firm*—Flehr Hohbach Test Albritton & Herbert LLP

[57] ABSTRACT

The invention relates to an ion trap mass spectrometer of the type having an ion trapping volume defined by spaced end caps and a ring electrode. The ion trap includes a small sensing electrode which senses characteristic motion of ions trapped in said trapping volume and provides an image current. Ions are excited into characteristic motion by application of an excitation pulse to the trapped ions. The invention also relates to a method of operating such an ion trap.

20 Claims, 34 Drawing Sheets

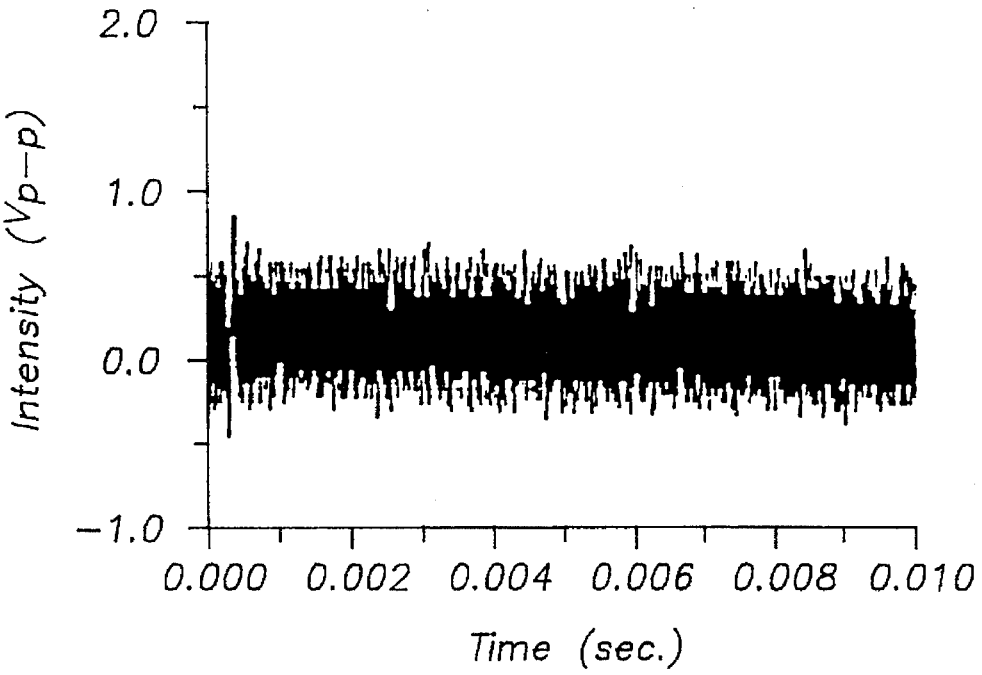
FIG.−10A
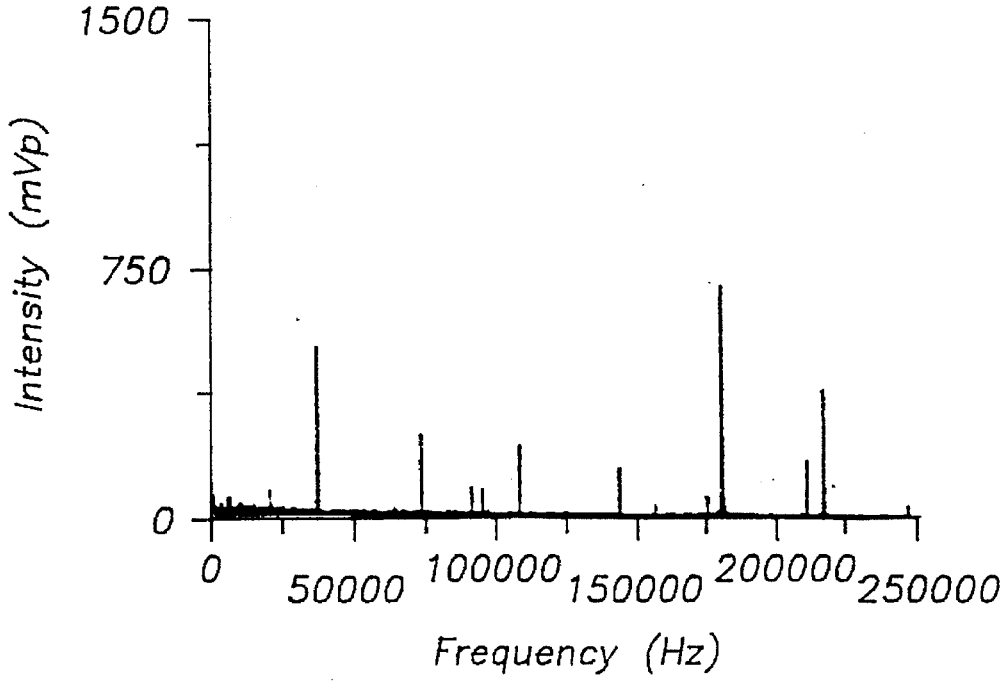
FIG.−10B

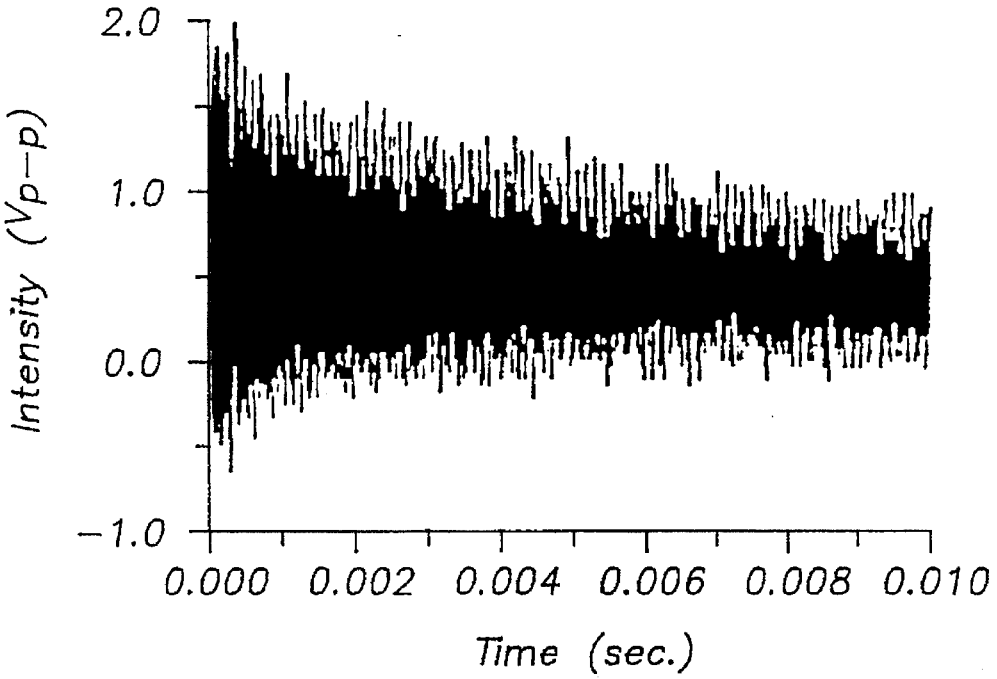
FIG.−10C
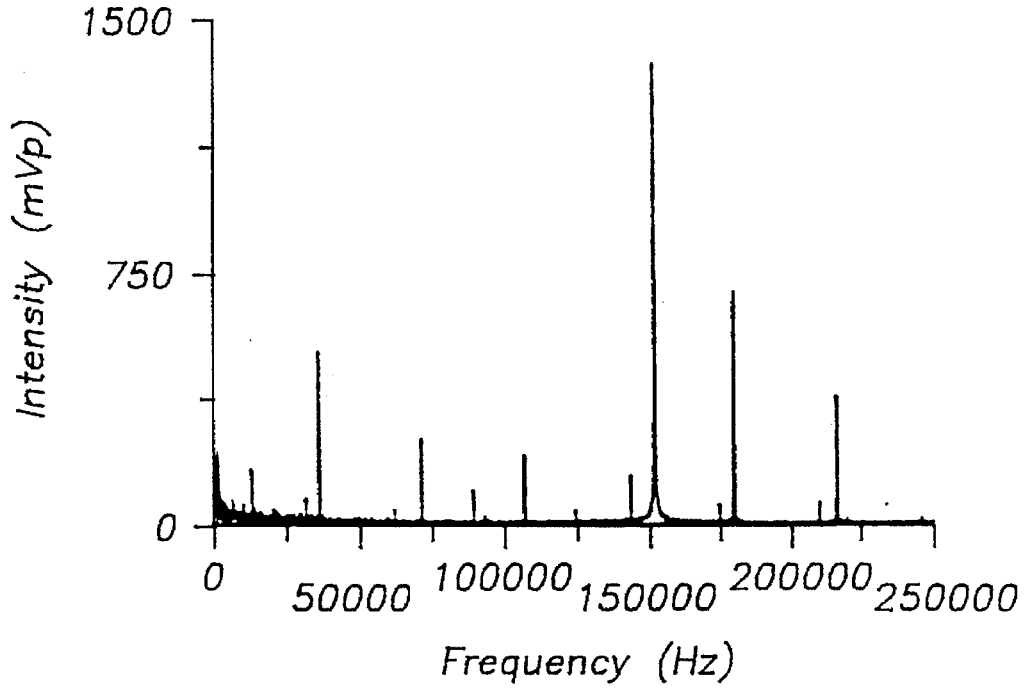
FIG.−10D

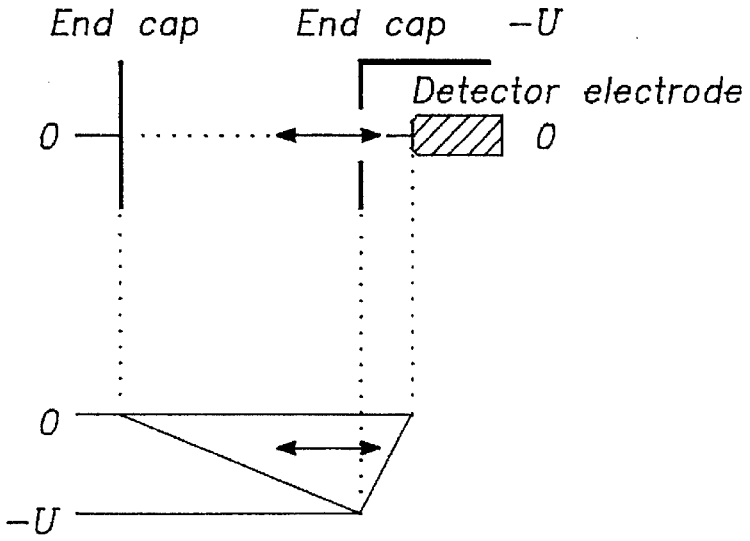
FIG.−19A
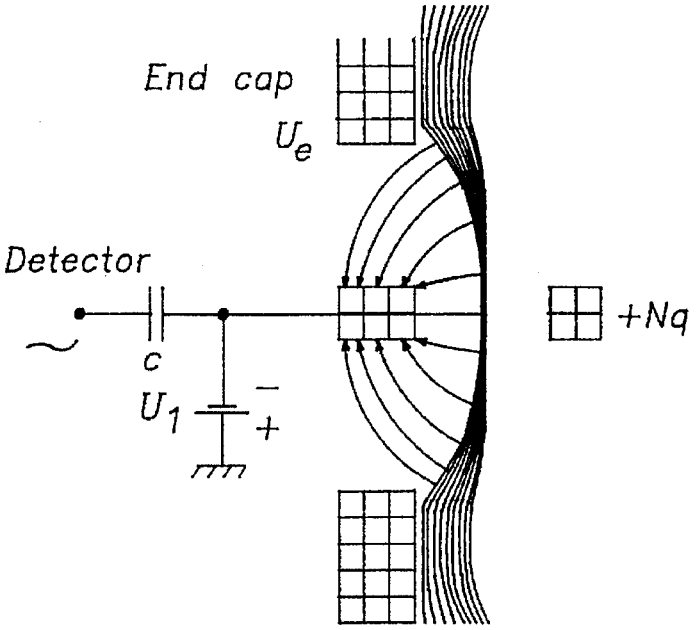
FIG.−19B

NON-DESTRUCTIVE ION TRAP MASS SPECTROMETER AND METHOD

BRIEF DESCRIPTION OF THE INVENTION

This invention relates generally to a non-destructive ion trap mass spectrometer and method of operation and more specifically to an ion trap mass spectrometer operation with ion image currents and an ion current detection electrode.

BACKGROUND OF THE INVENTION

An ion trap for generating a radially symmetric three dimensional trapping field is shown in FIG. 1. The trap includes three parts: a ring electrode 11 and two end caps 12 and 13. The interior facing surfaces of the electrodes have appropriate hyperbolic shape. The end electrode 12 is associated with an electron gun which projects ionizing electrons through the opening 14. The electron gun includes a filament assembly 15, a lens 16 and a gate 17. Ions are analyzed by exciting the ions such that they are ejected through the opening 18 formed in any cap 15. The ions are detected by the electron multiplier 19. See U.S. Pat. Nos. 4,540,884 and Reissue 3400 for operation of an ion trap as a mass spectrometer. A three dimensional ion trapping field is generated by applying rf and dc or rf only voltages to the trap electrodes. The Mathieu equations of motion of ions in a three dimensional trapping field define the voltages required to capture ions over a selected mass range. A discussion of the principles of operation of the quadrupole ion trap can be found in the book "Quadrupole Mass Spectrometry and its Applications" edited by Peter Dawson, pages 49–52 and 134–188. Radio frequency quadrupole ion traps are also discussed in chapter 4, pages 39–49 of the book Dynamic Mass Spectrometry, Vol. 4, edited by D. Price and J. F. J. Todd and the book by R. E. March and R. J. Hughes (Quadrupole Storage Mass Spectrometry), Wiley-Interscience, New York, 1989.

U.S. Pat. No. 4,755,670 describes a method of analyzing a wide mass range of ions captured in a quadrupole ion trap. The patent describes a method of forming and trapping a wide mass range of ions in a quadrupole field, exciting the ions by applying an electrical pulse to the ions such that it imparts into the ions coherent motion. The ion motion induces image currents in the end caps. The magnitude and frequency of the image current is proportional to the frequency and magnitude of the ions oscillating trajectory. The ion image current is then frequency analyzed and a frequency spectrum which corresponds to the mass spectrum is obtained.

Parks et al. [J. H. Parks, S. Pollack, and W. Hill "Cluster experiments in radio frequency Paul traps: Collisional relaxation and dissociation", J. Chem. Phys. 101 (8), 1994] demonstrated non-destructive detection of trapped $C_{60}$+ions with a detection sensitivity of<100 ions. The detection circuit connected to the end caps was designed for narrow band detection. Detection was accomplished at the resonance ion frequency using a resonant LC circuit with a sufficiently narrow bandwidth ($\omega_c/\omega$=200) to achieve low noise in the presence of large background signals at the rf drive frequency.

Goefinger et al. [D. E. Goefinger, R. I. Crutcher, and S. A. McLuckey "Ion remeasurement in the Radio Frequency Quadrupole Ion Trap", Anal. Chem. 67, 1995, 4164–4169] demonstrated narrow band non-destructive detection of ions in a quadrupole ion trap and ion remeasurement. The experiment was done by simultaneous excitation and image current detection using the ion trap electrodes. These authors used a transformer-coupled bridge circuit in order to circumvent a large contribution to the signal from the rf drive frequency in the detector signal.

The use of the ion trap electrodes to detect the image currents introduces a large capacitance which decreases the noise ratio.

OBJECTS AND SUMMARY OF THE INVENTION

It is an object of the present invention to provide an improved quadrupole mass spectrometer and method of operation.

It is another object of the present invention to provide a quadrupole mass spectrometer employing an ion trap having a separate image current detector electrode and method of operation.

It is another object of the present invention to provide a quadrupole mass spectrometer having a wide band detection system with filtering of the ion trap rf drive signals.

It is a further object of the present invention to provide a method for non-destructively detecting ions trapped in an ion trap by rf quadrupole fields.

In accordance with the present invention the ion trap used in the quadrupole mass spectrometer includes a ring electrode, spaced end caps and an image current detector electrode extending into said trap for providing ion image current. The image currents are detected with a wide band low impedance preamplifier with filtering of the rf trapping drive signal.

Also in accordance with the invention trapped ions are excited with an excitation signal to cause the ions to oscillate at their characteristic frequency. The ions induce image currents in a small detector electrode positioned in an end cap (or elsewhere in the device) to provide an ion image signal. The ion signal is processed to provide a frequency spectrum and/or a mass spectrum of the trapped ions.

BRIEF DESCRIPTION OF THE DRAWINGS

The foregoing and other objects of the invention will be more clearly understood from the following description taken in conjunction with the accompanying drawings wherein:

FIGS. 10A–E show non-destructive detection of Argon m/z 40 using a delay between ionization and detection and detection following ac excitation.

FIGS. 19A–B show an ion trap and field lines with a negatively biased electrode.

DESCRIPTION OF PREFERRED EMBODIMENT

Figure 2:
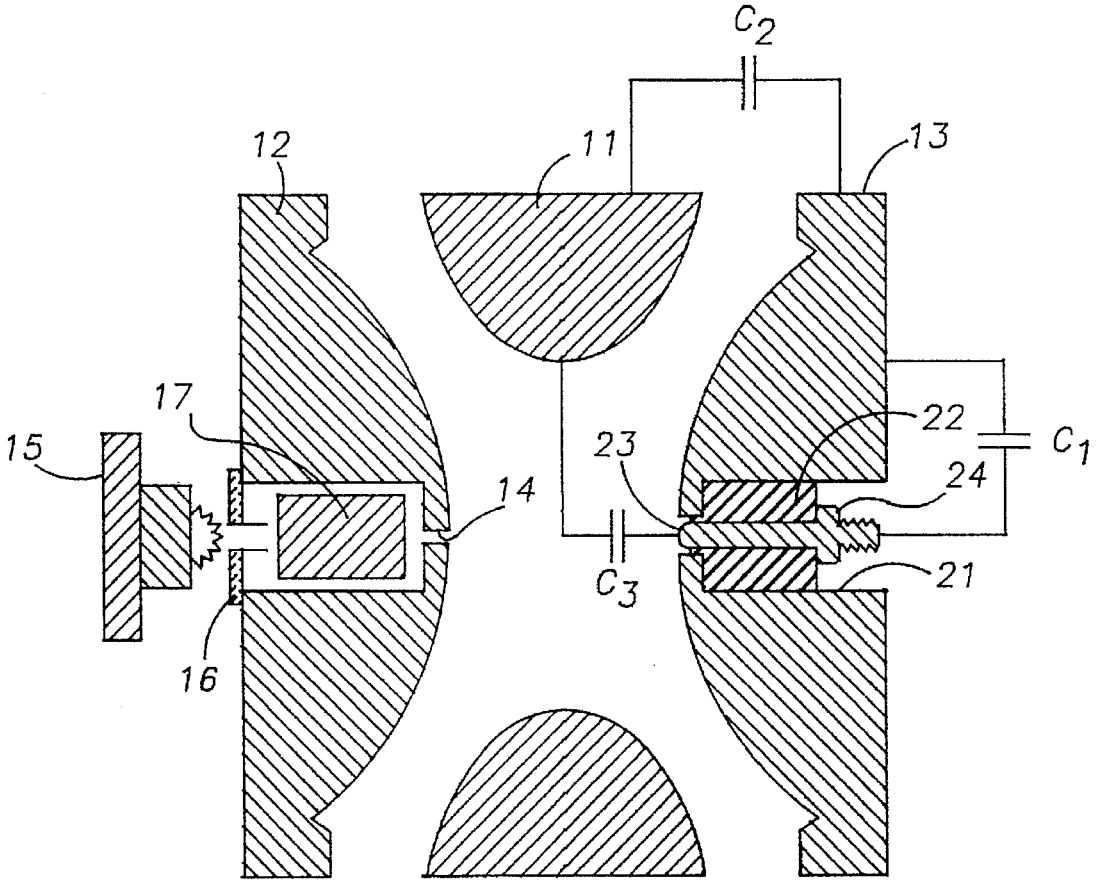
FIG. 2 shows an ion trap in accordance with the present invention with a detector electrode.

The ion trap shown in FIG. 2 includes a ring electrode 11 and end cap electrodes 12 and 13. The ion trap includes an electron gun for injecting electrons onto the ion trap to ionize a sample within the trap. It is to be understood that rather than forming ions in the ion trap they can be formed externally to the trap and then introduced into the trap. The electron gun includes a filament 15 for producing electrons, a lens 16 and a gate 17 to control the transmission of electrons into the ion trap through the end cap opening 14. The end cap 13 includes a well 21 which receives an insulating support 22. The support 22 supports detector electrode 23 which generates imaging currents in response to the motion of ions in the ion trap. The penetration of the electrode 23 can be adjusted by the nut 24.

Figure 3A:
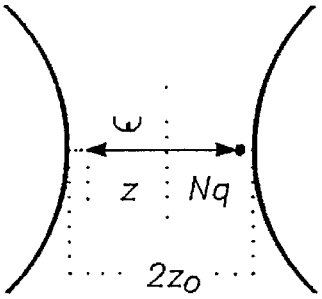
FIGS. 3A–3C show image current models.
Figure 3B:
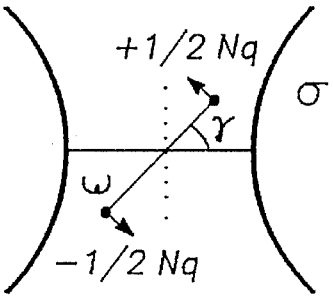
Figure 3C:
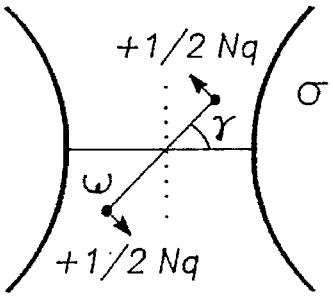

The image current in the detector electrode can be determined from the rotating monopole model shown in FIGS. 3A–3C as suggested by Comirsarow et al. The following treatment is adapted from this reference. If a packet of N ions is concentrated in volume, V, the electric dipole is:

$$\mu = \tfrac{1}{2} Nq*(2z) = Nqz$$

and the macroscopic polarization P is given by:

$$P = \mu/V = Nq*\frac{z}{V}$$

where z is the excursion of the ion packet from the center of the trap and q is the charge on an ion.

By making an assumption that the image charge on the electrode is concentrated at the nearest point seen from circulating cloud of ions, the density of the charge on the electrode is given in terms of $\hat{\omega}$ the frequency of ion oscillation, as:

$$\sigma = -P\cos(\omega t) = -\frac{Nqz}{V}\cos(\omega t)$$

Thus, if the area of the detector plate is A, the total charge on the end cap plate is given by $$Q(t) = \sigma A = -\frac{NqzA}{V}\cos(\omega t)$$

This equation gives the instantaneous charge Q(t) on the plate of the ion trap as a function of N, the total number of excited ions; q, the ion charge; z, excursion of the ion from the center; V, the volume occupied by the ions and $\hat{\omega}$ the frequency of ion oscillation. The full current to the detector plate is given (for a planar electrode) by the time derivative of the charge on the plate:

$$I_S(t) = \frac{dQ}{dt} = \frac{NqzA}{V}\omega\sin(\omega t)$$

or alternatively, $$I_S(\text{rms}) = \frac{NqzA\omega}{V\sqrt{2}}$$

where $I_s$(rms) the root mean square value of image current.

Detection and recording of the ion image signal requires that the signal be converted to a voltage which is then amplified to some convenient level. Conversion of the image current to the voltage signal can be accomplished by connecting the detector electrode via a resistor. The resistor will, however, introduce random signal (electrical noise) which is included as part of the measured signal. This noise current is given by:

$$I_n(\text{rms}) = \sqrt{\left(4kT\Delta f\frac{1}{R}\right)}$$

where $I_n$ (rms) is the root mean square noise current in a measurement for which the detection bandwidth is Δf (Hz), k is the Boltzman constant, T is the temperature of the resistor and R is the resistance. The rms noise voltage is:

$$V_n(\text{rms}) = I_n*Z$$

where Z is a parallel impedance in the RC circuit, $$Z = \sqrt{\left(\frac{1}{R^2} + \omega^2C^2\right)^{-1}} \quad ; \quad V_n(\text{rms}) = \sqrt{\frac{4kT\Delta f\frac{1}{R}}{\frac{1}{R^2} + \omega^2C^2}}$$

hence for $1/R \ll \omega C$:

$$V_n(\text{rms}) = \frac{\sqrt{4kT\Delta f \frac{1}{R}}}{\omega C}$$

The signal current $I_s(t)$ is a sum of the current flowing through both branches of the parallel RC circuit:
$I_s(t)$=(current through R)+(current through C)

$$I_s(t) = \frac{V_s(t)}{R} + C\frac{dV_s(t)}{dt}$$

The equation for $V_s$(rms) is:

$$V_s(\text{rms}) = \frac{NqzA}{V\sqrt{2}}\,\omega\sqrt{\left(\frac{1}{R^2} + \omega^2 C^2\right)^{-1}}$$

For a circuit which is mainly capacitive, $1/R \ll \omega C$ and $$V_s(t) = \frac{NqzA}{CV}\sin(\omega t - \pi/2)$$

and hence substituting $1/(2z_0)$ for A/V (area/volume):

$$V_s(t) = \frac{Nqz}{2Cz_0}\sin(\omega t - \pi/2)$$

This equation gives the instantaneous voltage signal $V_s(t)$ for conditions $1/R \ll \hat{\omega} C$, viz. for a circuit that is predominantly capacitive, as a function of N, the number of ions; q, the ion charge; z, the ion excursion and C, capacitance.

The ion trap sensitivity, i.e. signal to noise ratio, S/N is given by $$\frac{S}{N} = \frac{V_s(\text{rms})}{V_n(\text{rms})} = \frac{Nqz\omega\sqrt{R}}{4z_0\sqrt{2kT\Delta f}}$$

From the above equations, the following methods of increasing the image voltage signal and signal/noise ratio can be used: (1) Operate at low temperature (reduce Johnson noise), (2) Used more trapped ions (increase signal), (3) Change geometry of the trap (e.g. decrease $z_0$), (4) Change operating conditions to increase secular frequency, (5) Decrease band-width and (6) decrease the capacitance. This last method can be implemented by reducing the size of the detector electrode, provided that the image current produced by the oscillating ions can be caused to impinge on the small detector electrode rather than in the surrounding end-cap electrode.

Figure 4A:
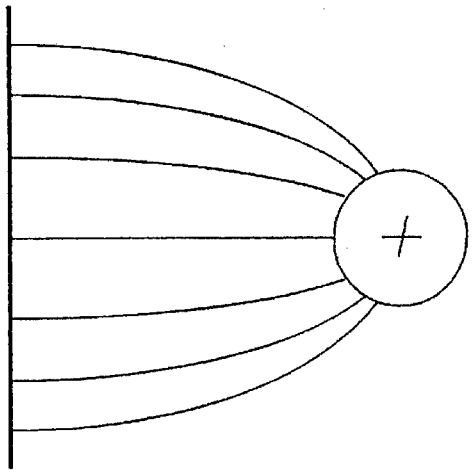
FIGS. 4A–4B show electric fields generated by an ion packet terminating on a plate and a small detector surface.
Figure 4B:
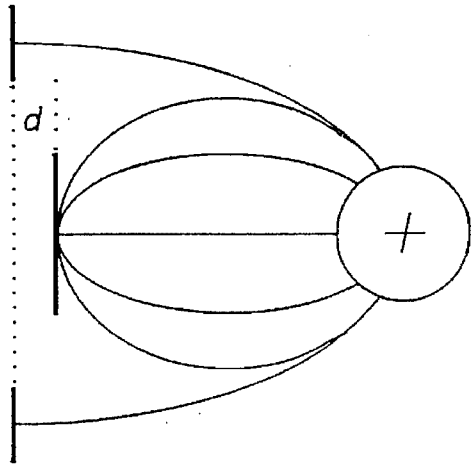

The signal produced by oscillating ion packet is proportional to the number of electric field lines produced by this packet which terminate on the surface of the receiver plate or electrode 23. The electric field lines generated by a charge ion packet terminate on the surface of the detector electrode as well as on the surrounding end-cap electrode. By positioning the detector appropriately, distance "d" past the large plate (end electrode), the field lines can be made to terminate in this detector in spite of its reduced area. Referring to FIGS. 4A and 4B, it is seen that a similar number of field lines can terminate on the small detector plate as on the large plate, thus there need be little or no loss of sensitivity when using a small area detector.

A small imaging detector plate also reduces the influence of the RF field from the ring electrode on detected signal. This field influences the electrodes through the stray capacitances that exist in the trap. The total capacitance C between ring electrode and detector plate is represented in FIG. 2. It consists of $C_1$, the capacitance between the detector plate and end-cap electrode (first capacitor), $C_2$, between the ring electrode and the end cap (second capacitor) and $C_3$ between the detector and the ring electrode (third capacitor). The first and second capacitors are in series and third is in parallel. Total capacitance is given by:

$$C = \frac{C_1 * C_2}{C_1 + C_2} + C_3$$

The value of the capacitance $C_2$ (ring electrode-endcap) depends on the trap dimensions and is normally equal to 10–15 pF. The high voltage RF field induces a significant signal on the end-cap through this capacitance. The value of the capacitance $C_1$ depends on the dimensions of the detector in respect to the end-cap hole dimension. The capacitance $C_1$ can be made small (1–5 pF) when the diameter of the detector is much smaller than end-cap hole diameter. The capacitance $C_3$ is small with respect to the $C_1$ and $C_2$. The total capacitance C will be equal to:

$$C = \frac{C_1 * C_2}{C_1 + C_2} \quad \text{for } C_2 \gg C_1$$

The above analysis shows that reduction in the capacitance of the detection circuit is an effective method of increasing the S/N of detection of a given signal using a fixed bandwidth amplifier. The advantage of this detector has already been illustrated schematically in FIG. 4B which shows that the ion image is recorded equally well on a small area detector as on a large area detector. The former, however, will show higher signal levels (point 6) above) as well as showing lower systematic noise levels because of its smaller capacitance.

Figure 5:
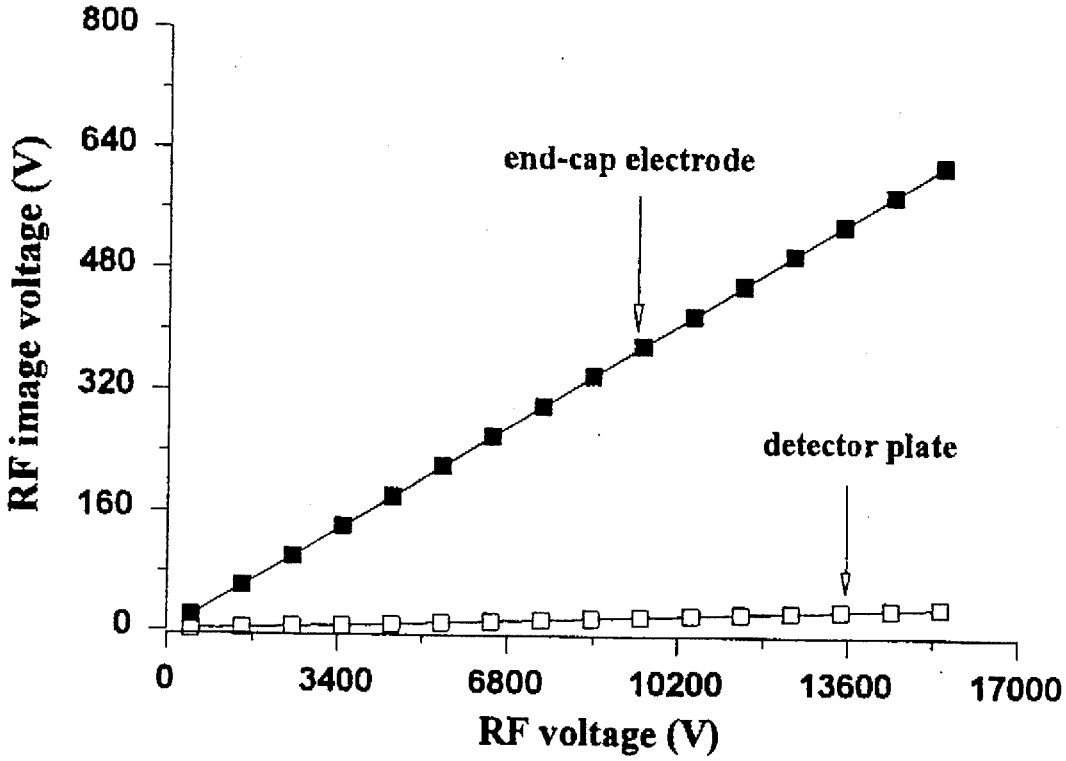
FIG. 5 shows the signal on an end cap electrode and on a detector electrode as a function of rf voltage in the absence of added sample.

The systematic noise of the RF field from the ring electrode on the end-cap and detector plate was demonstrated experimentally. The RF voltage (1.1 MHz) on the ring electrode was varied by changing the start-mass and stop-mass parameters on the Finnigan ITMS data system. These mass values can be directly converted to actual voltages using the Mathieu equations. The sinusoidal image signal on the end-cap electrodes and detector electrode was measured using a Tektronix Model 540 digital oscilloscope using a 50 ohm input resistance and recording the peak to peak amplitude. The ratio of the RF image signal (i.e. the contribution from the background signal) for the end-cap and the detector plate is equal to $$\frac{N_{endcap}}{N_{detector}} = 200$$

where $N_{endcap}$ is the RF image signal on the end-cap and $N_{detector}$ is a RF image signal on the detector plate. FIG. 5 shows the reduction in the background signal due to RF pickup using a small area detector electrode compared with a large area end-cap electrode as detector.

Figure 6:
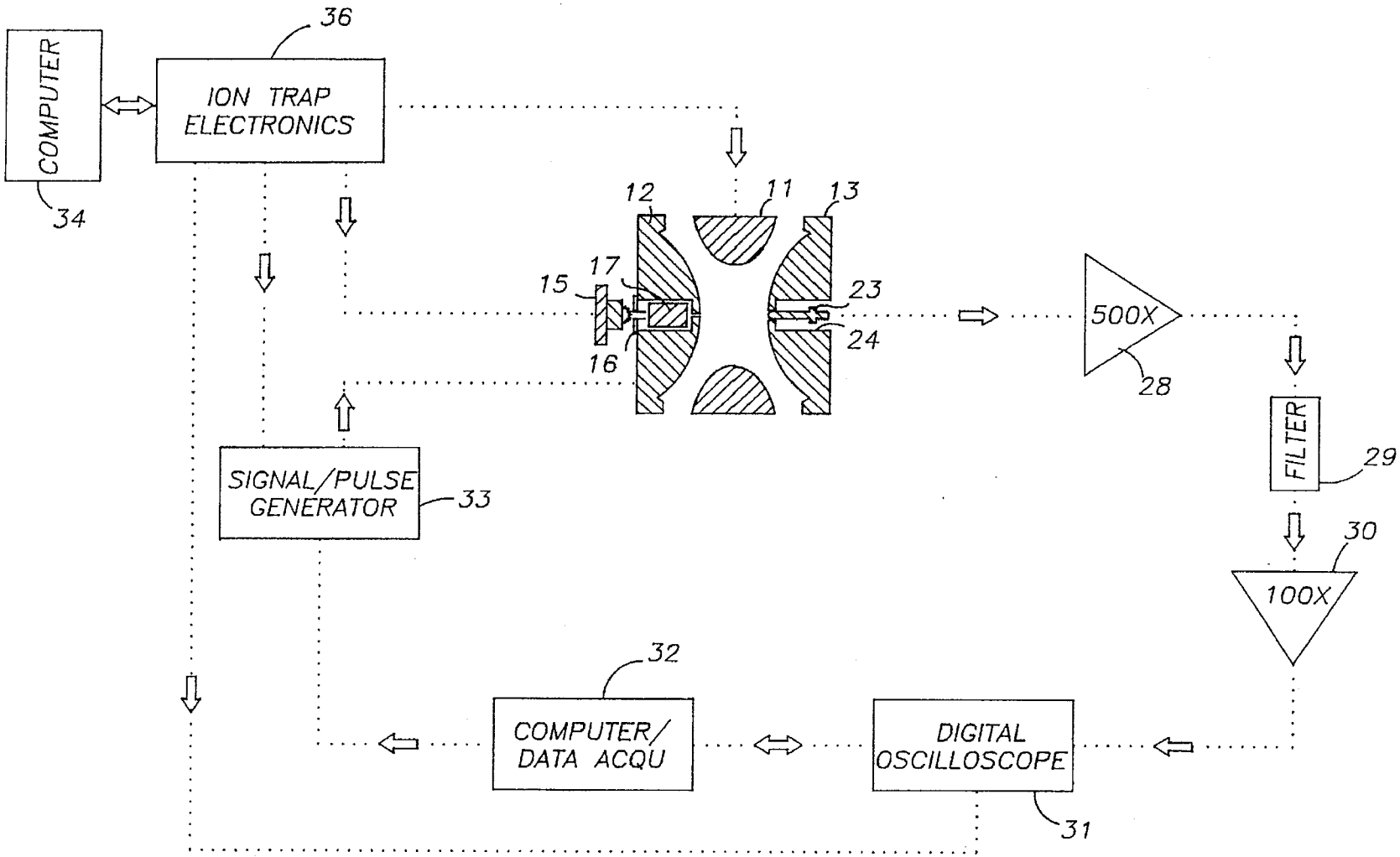
FIG. 6 is a schematic diagram of a quadrupole mass spectrometer system in accordance with the present invention.

A schematic diagram of the instrumentation used in the ion trap mass spectrometer of the present invention is shown in FIG. 6. The image current generated at the detector electrode 23 is converted into a voltage at the input of the preamp 28 by a 10 M resistor connected between the detector electrode 23 and ground (not shown). The preamp can be operated in the differential detection mode using dual detector electrodes one on each end-cap electrode, as will be described, or in the single-ended detection mode where the second input of the preamp is grounded. In the experiments to be described, the preamp was operated in the single-ended configuration. The overall gain of the preamp in the experiments to follow was 500. The current transfer ratio of the preamp was 5 mVp for 1 pA current at the detector electrode. The output of the preamp was fed into a ITHACO 4302 dual 24 Db/Octave filter amplifier 29 operated at 100 gain with a bandwidth setting of 400 kHz. Thus an image current of 1 Pa at the detector plate yields 0.5 Vp at the output of the amplifier 30. This signal is fed into a Tektronics digital oscilloscope 31 (Model TDS 540) operating at 1 M input resistance, sampling rate 1 Mhz and a horizontal resolution of 15k data points. This yields a 15 ms signal acquisition window. Note that some experiments also utilized an acquisition window of 50 ms (50K data points @1 MHz). For all experiments the scope was operated in the signal averaging MHz (running average) mode where the signal was averaged over about 100 scans. The scope had a real-time FFT capability for 10k data points and this mode was utilized for some experiments, again with signal averaging. However for a majority of the experiments, data was collected by capturing the time domain signal (transient) into the scope buffer memory (15k data points) and downloading it onto a computer 32 via a GPIB interface. The ASCII formatted data was further processed using STATMOST (ver 2.1) spreadsheet program. The processing includes background subtraction and FFT calculation.

Excitation was achieved by applying to the end-cap electrode adc signal derived from a home-built dc pulser 33 capable of outputting signals of several hundred volts with a rise time of 10 nanoseconds. In some experiments an ac excitation signal (Wavetek model 395 arbitrary wave form generator) was applied to the opposite end-cap (the injection end-cap) in order to perform single-cycle or multiple cycle ac excitation. The excitation signal or pulse has a frequency distribution which includes the frequencies corresponding to the characteristic frequencies of motion for the ions in the range of mass-to-charge ratios to be analyzed to cause characteristic motion of the ions. Ion isolation, stored waveform inverse Fourier transform (SWIFT), SWIFT isolation and excitation, and resonant excitation are all standard ion trap experiments and were performed using procedures described in the ion trap literature.

Figure 7:
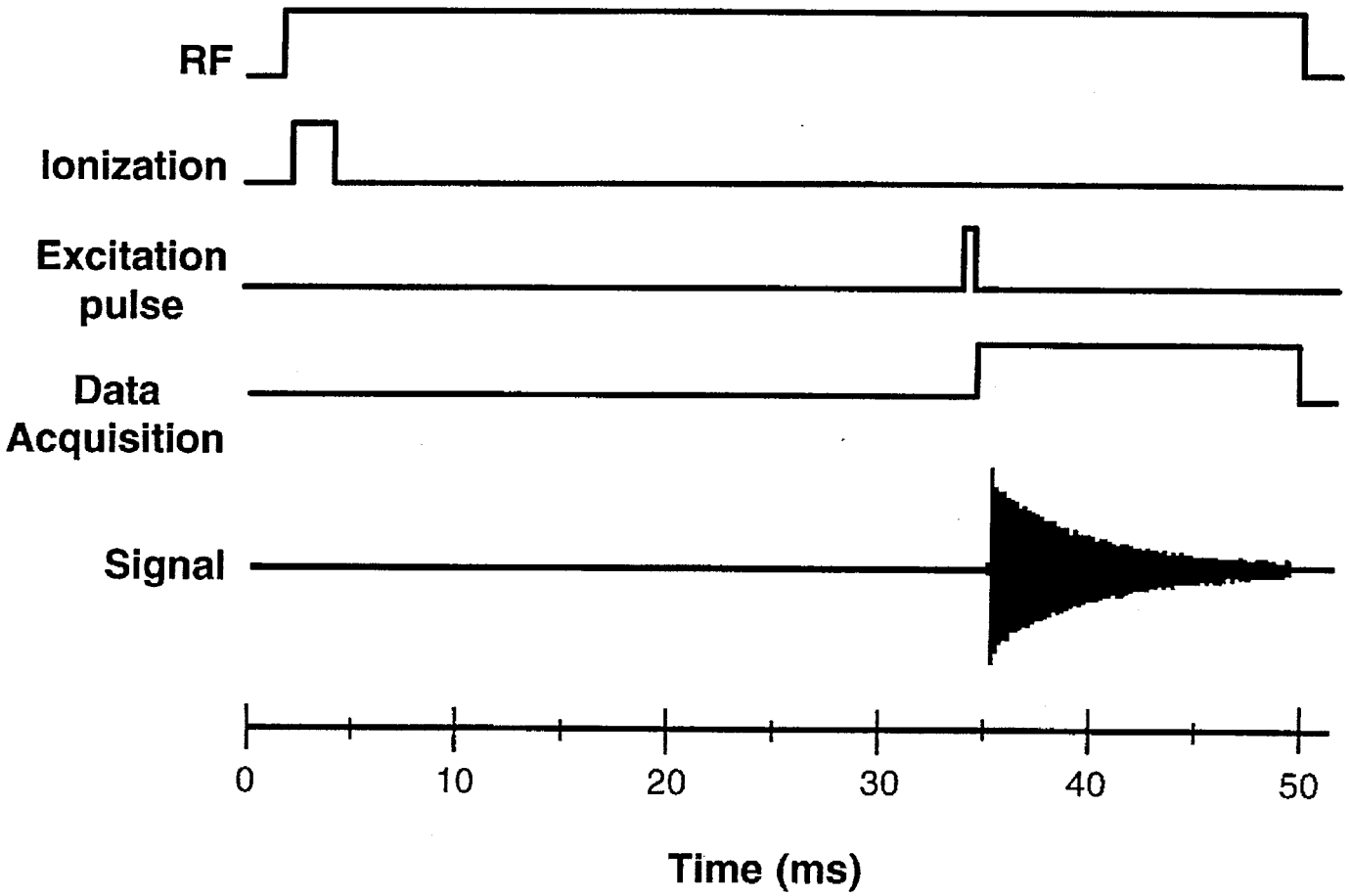
FIG. 7 is a timing diagram for recording spectra using non-destructive ion detection.
Figure 8:
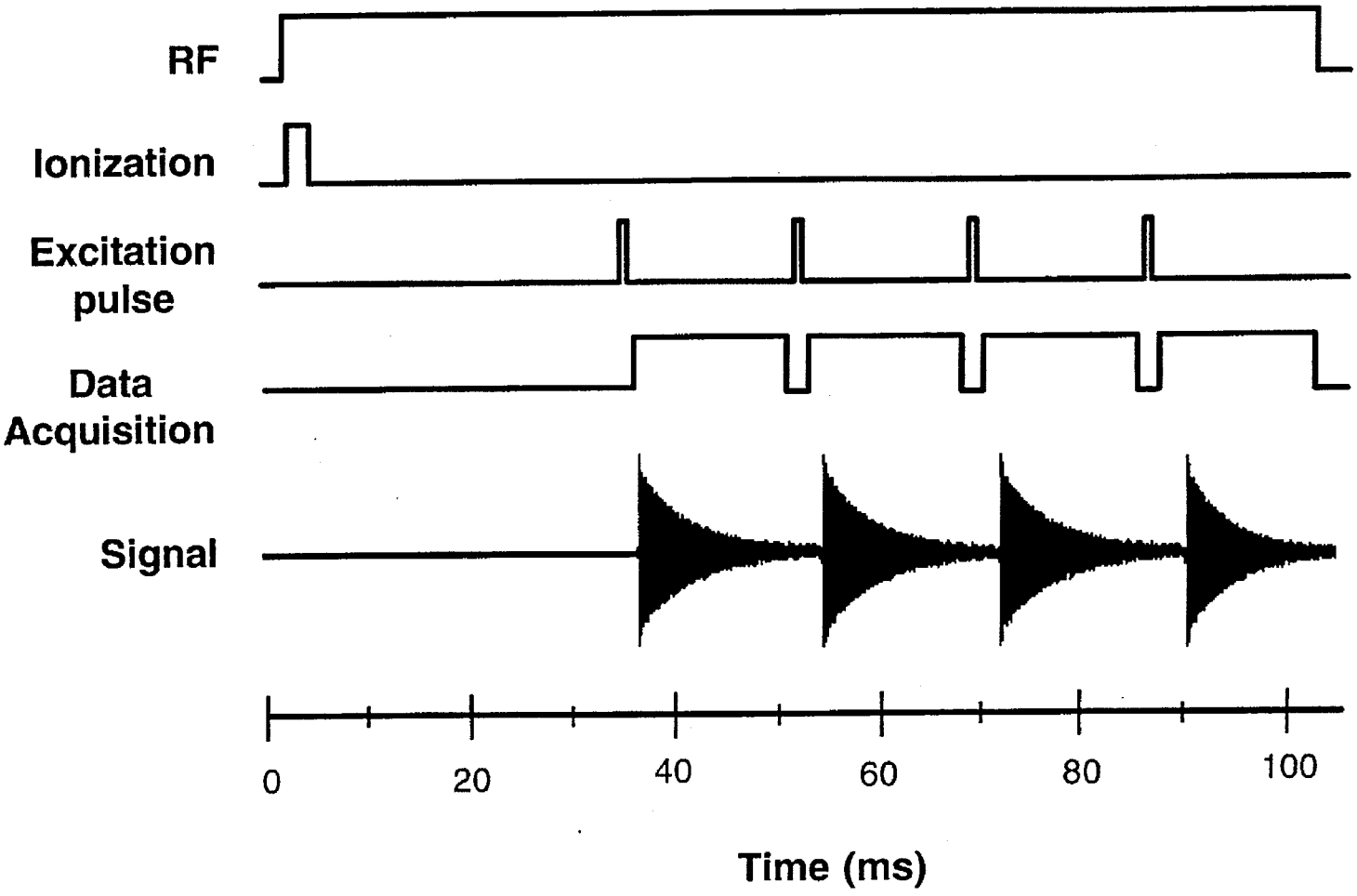
FIG. 8 is a timing diagram for repetitively recording spectra of ions in a sample to average the detection signal.

The computer 34 and ion trap electronics 36 control operation of the ion trap. Many of the experiments described below employed a sequence of signals applied to the ion trap electrodes which together constituted a timing diagram. FIG. 7 shows a typical timing diagram for recording a simple mass spectrum after single pulse dc activation using non-destructive ion detection. FIG. 8 shows a typical diagram for repeated excitation and ion detection of the same ions to average the results.

Figure 9A:
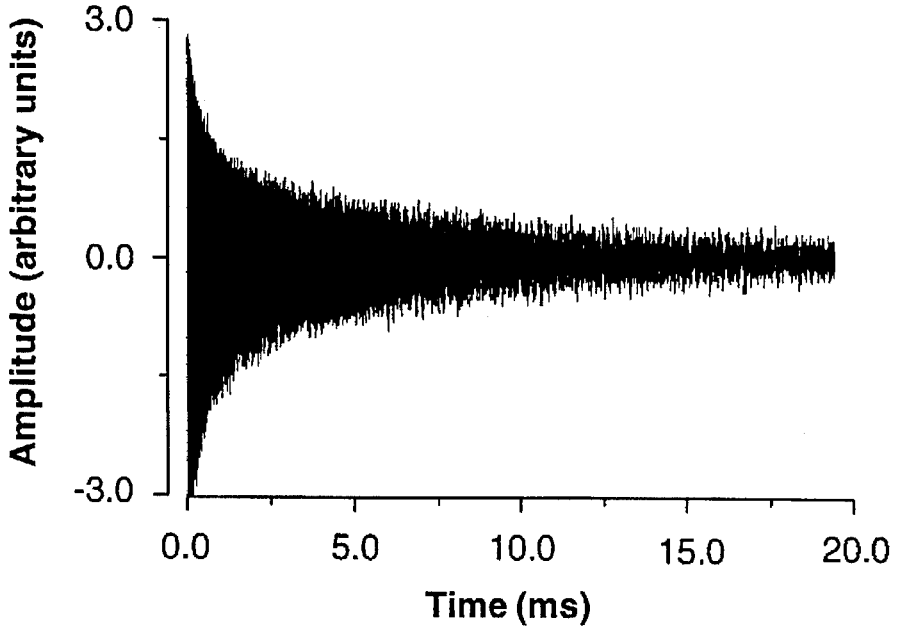
FIGS. 9A–9D show the image current and frequency domain for operation of the mass spectrometer with trapped Argon ions compared with no trapped ions.
Figure 9B:
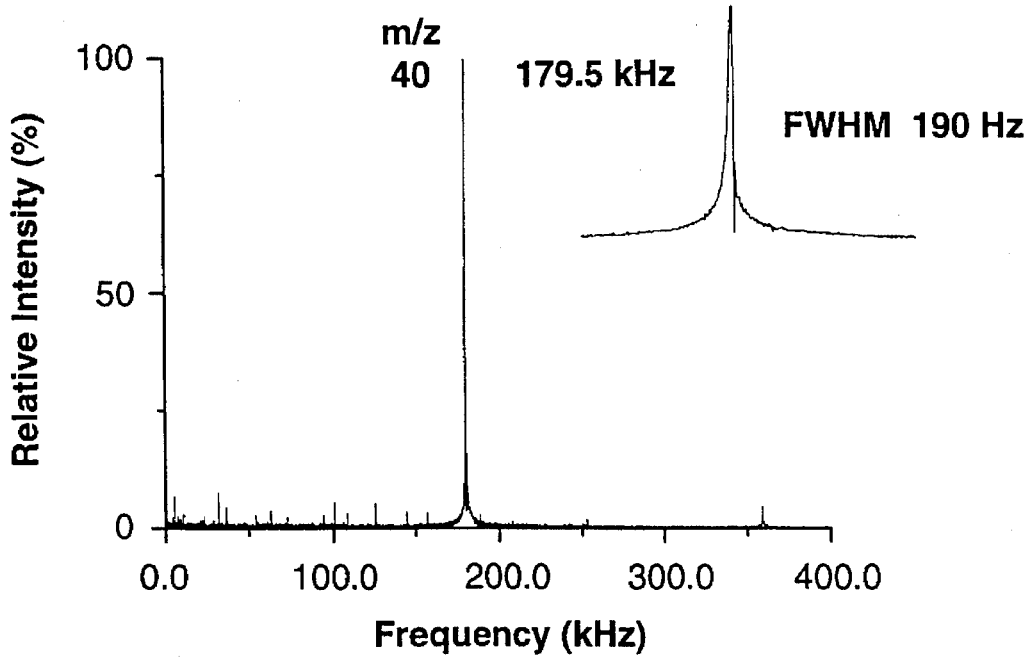
Figure 9C:
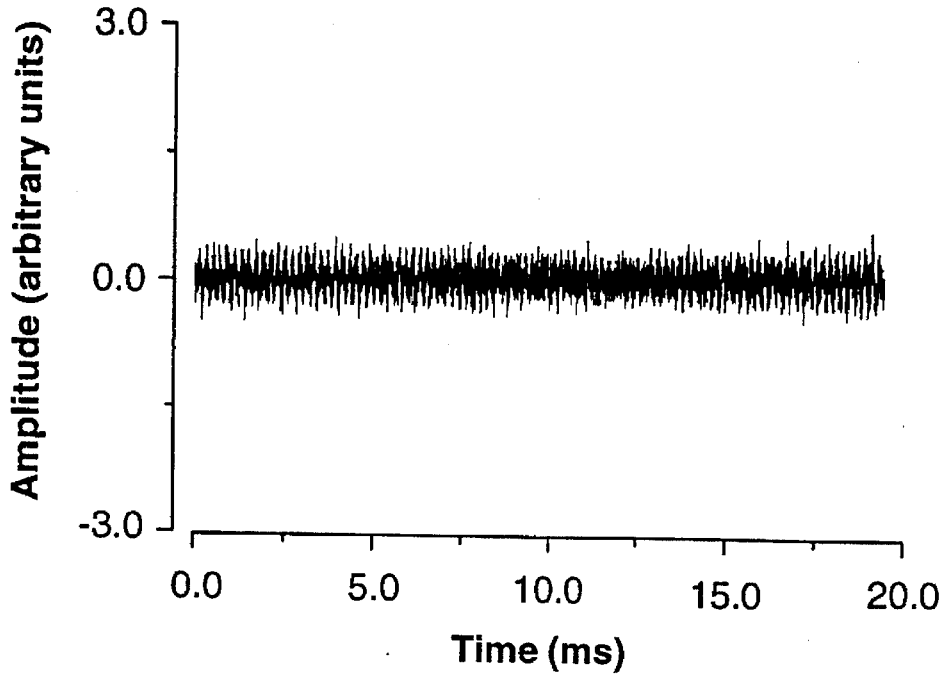
Figure 9D:
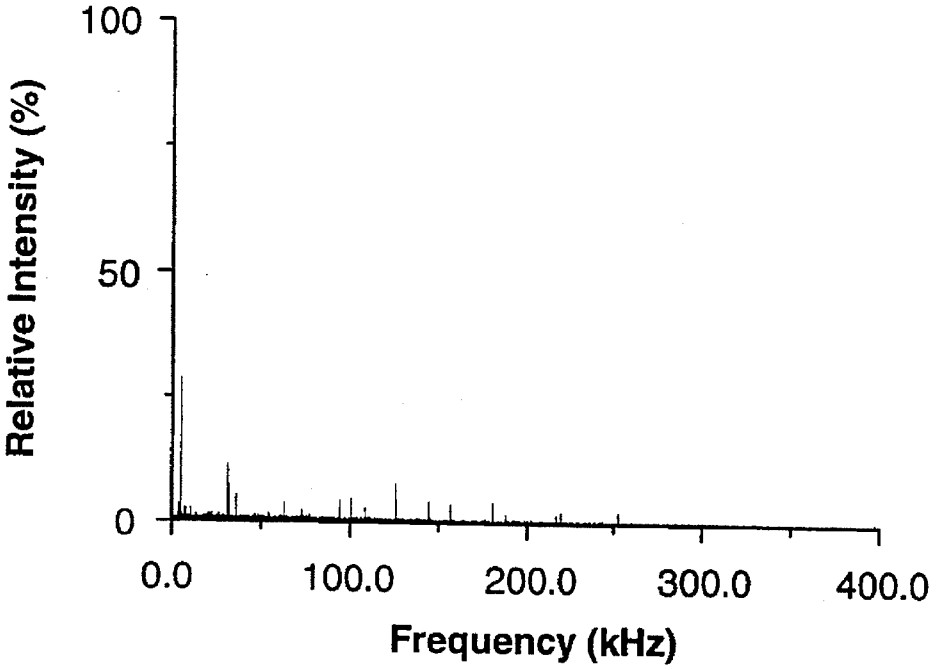

The procedures just outlined have been used to perform non-destructive detection experiments on populations of $Ar^+$ ions, generated by internal electron impact ionization and then cooled before DC pulse excitation and non-destructive detection through Fourier analysis of the image current. The low mass cutoff was m/z 20, the pressure of argon $1\times10^{-6}$ Torr, excitation employed a DC pulse of 23 volts for 2 microseconds. FIG. 9A shows the transient in the time domain for such an experiment and FIG. 9B the corresponding frequency domain data. For comparison, the time and frequency domain data for a blank are also shown in FIGS. 9C and 9D. It is noted that many of the signals in the blank also occur in the sample spectrum and that background subtraction improves signal/noise. The noise sources in the experiment include contributions from turbopump microphonics. The 190 Hz peak width of the signal and the ca. 10 ms length of the transient should be noted.

Simultaneous excitation and detection, using ac rather than dc excitation pulses, were investigated. These experiments were carried out without added helium at a nominal trap pressure of $7\times10^{-7}$ torr. The excitation frequency was scanned from 20 KHz to 190 KHz. The ac excitation was applied to the entrance end-cap electrode but it coupled strongly to the detector circuit (the detector electrode in the exit end-cap) and subtraction of the background signal at each ac frequency was therefore required.

Figure 10E:
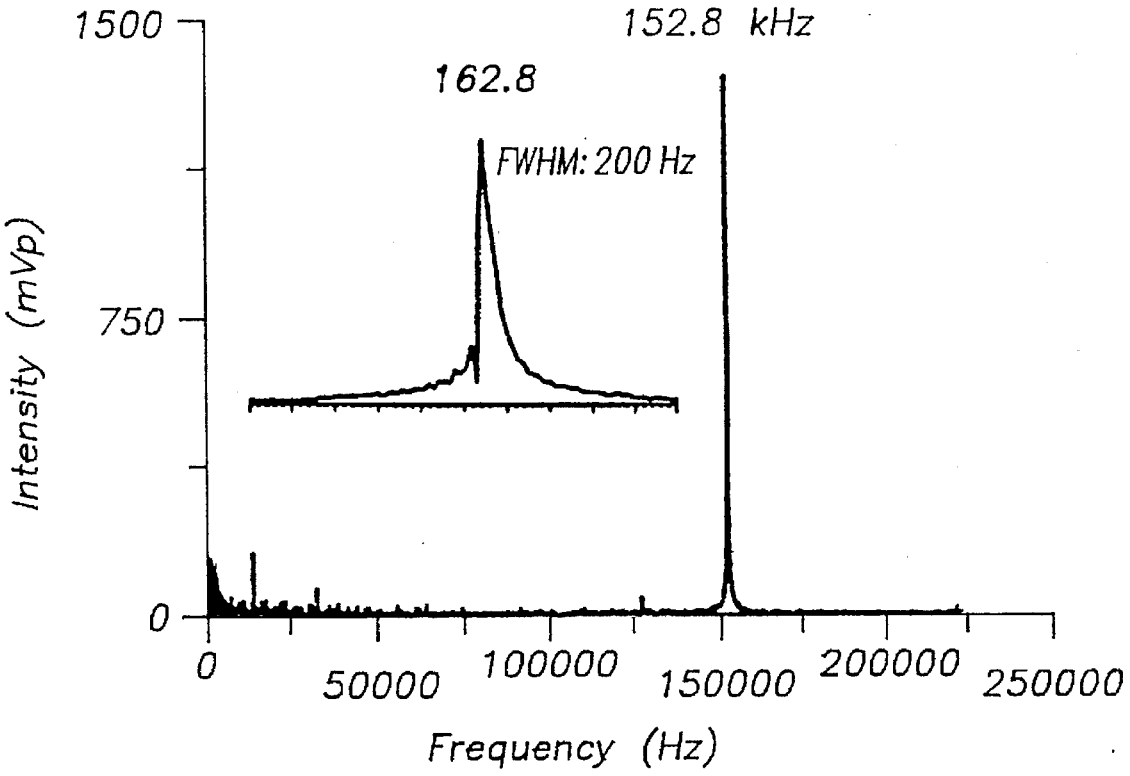

A series of experiments were conducted with ac excitation followed by detection. FIG. 10 summarizes the results. FIG. 10A shows background time domain, FIG. 10B shows signal plus background time domain, FIG. 10C shows frequency domain background, FIG. 10D shows the frequency domain signal plus background and FIG. 10E shows the signal alone. The data are all for m/z 40 and are for 0.1 ms excitation times. There was a delay of 30 ms after ionization and prior to excitation and detection. The detector electrode was repositioned for these experiments and the resonance frequency was dependent on the exact position.

Figure 11:
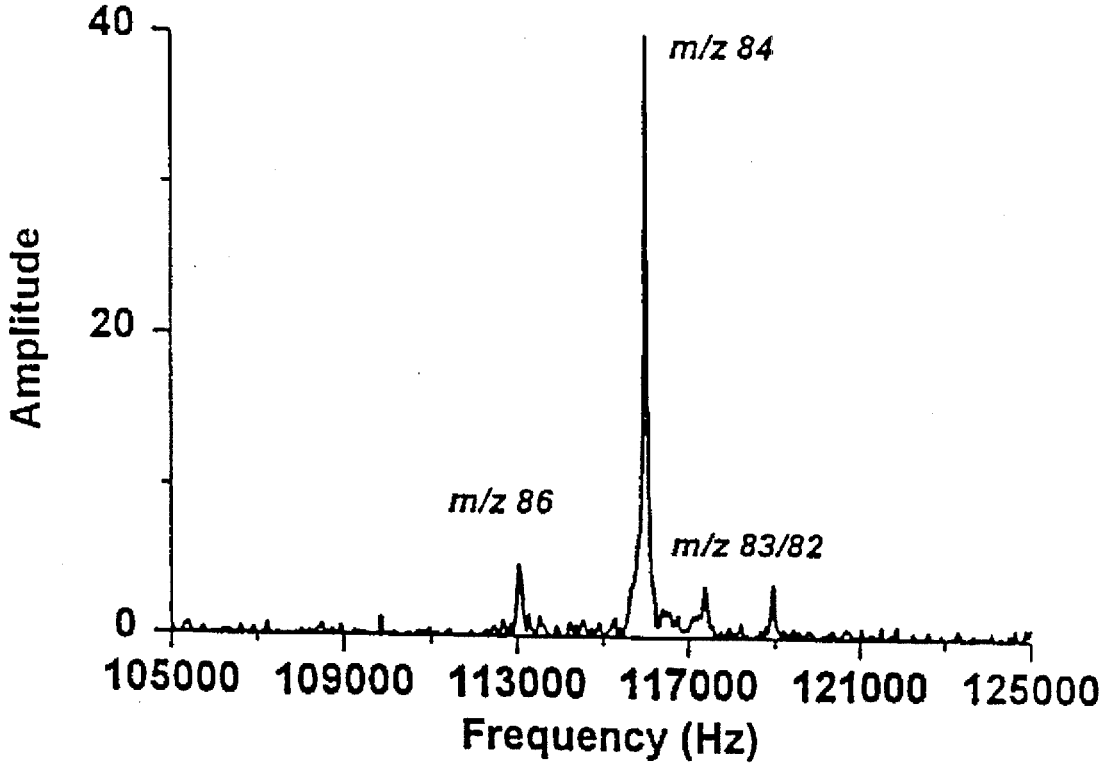
FIG. 11 shows the spectrum of krypton recorded using a single ac cycle as excitation.
Figure 12A:
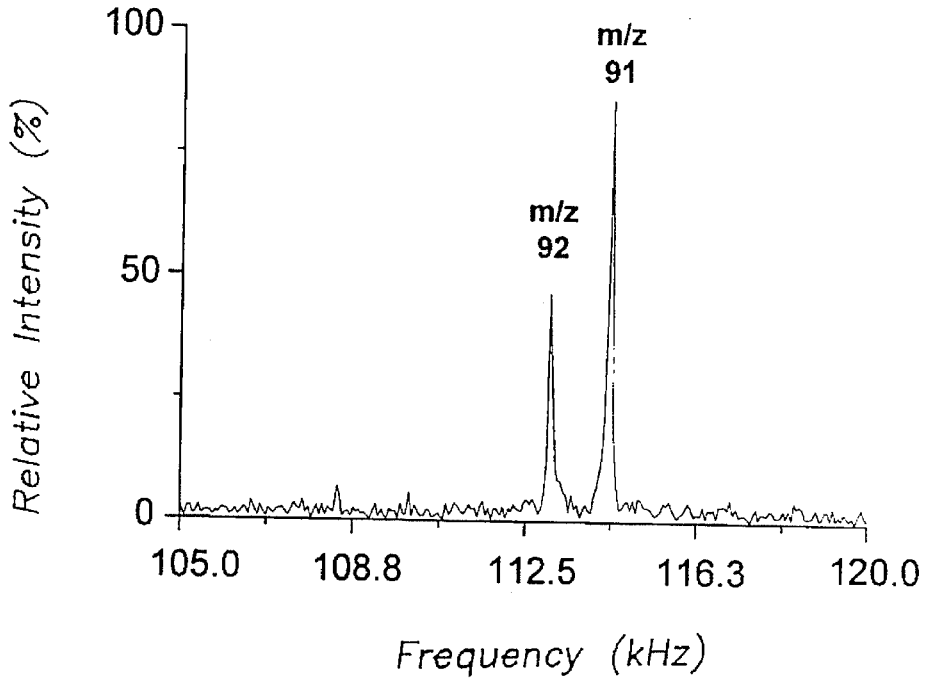
FIGS. 12A–F show the spectra of n Butylbenzene m/z 91 and 92 for different operating conditions using ac excitation.
Figure 12B:
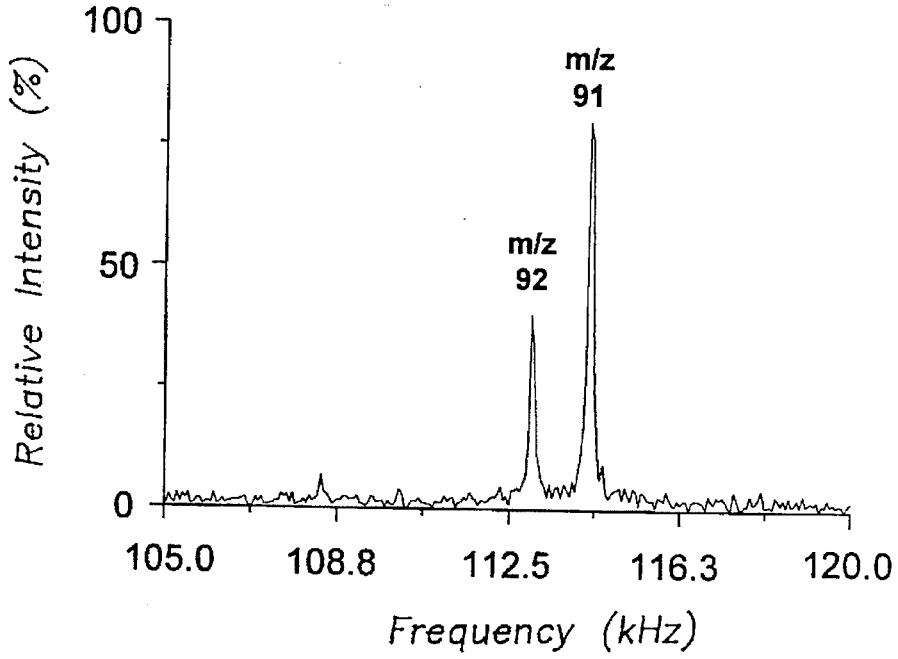
Figure 12C:
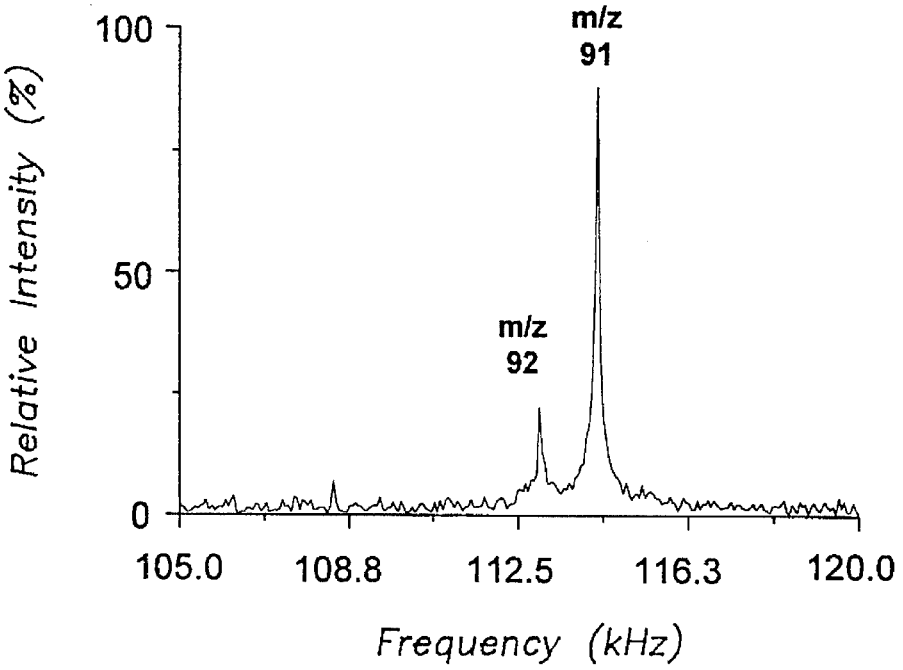
Figure 12D:
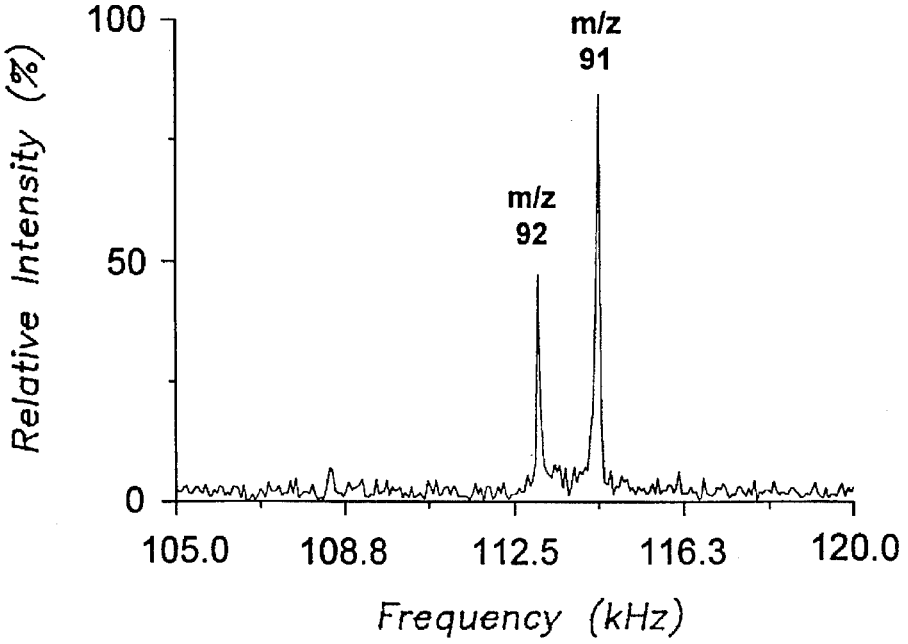
Figure 12E:
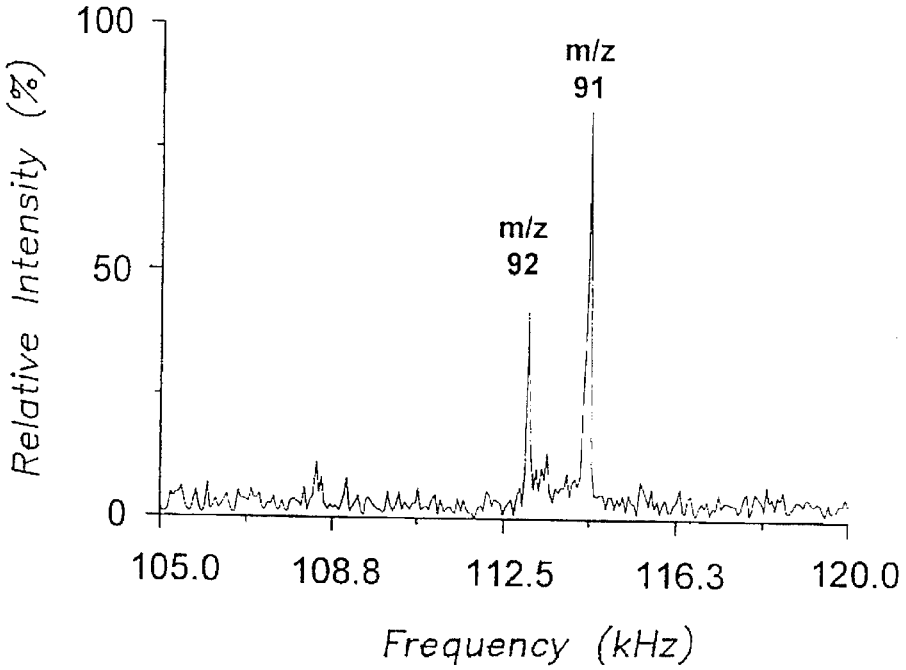
Figure 12F:
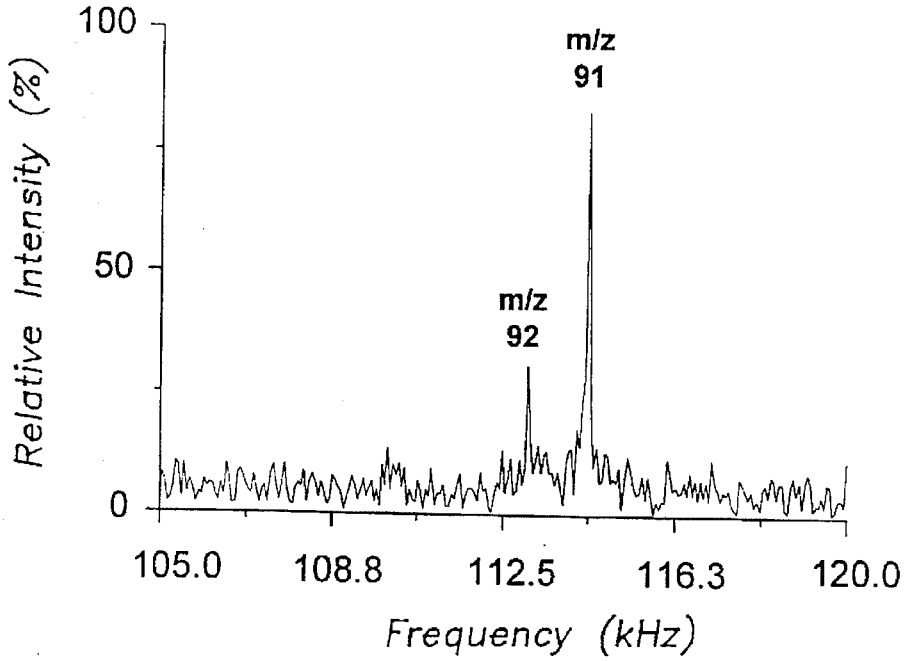

Single cycle ac excitation was explored as an alternative to longer ac excitations or adc pulse for excitation of a group of ions into coherent motion. The data obtained were not of as high a quality as the dc excitation but are of interest. FIG. 11 summarizes the type of data obtained, showing a krypton spectrum ionized for 6 ms, excited with a single cycle of ac (115 Khz, 2.15 Vp). The image current was detected after 65 ms. It is noted that the various isotopes occur at ion frequencies which are offset from the calculated values by almost the same amounts. Similarly, the data shown for n-butylbenzene in FIGS. 12A–F are of good quality and show resolution of m/z 91 and 92. As expected however, increased ionization times lead to space charge effects which lead to poorer resolution and the relative peak heights are sensitive to the value of the ac frequency chosen. The data was obtained with one ac cycle at 2.4 volts for FIGS. 12A–D, 2.2 v FIG. 12C and 2.0 v FIG. 12F. The ionization time was 10 ms for FIGS. 13D–F.

Figure 13A:
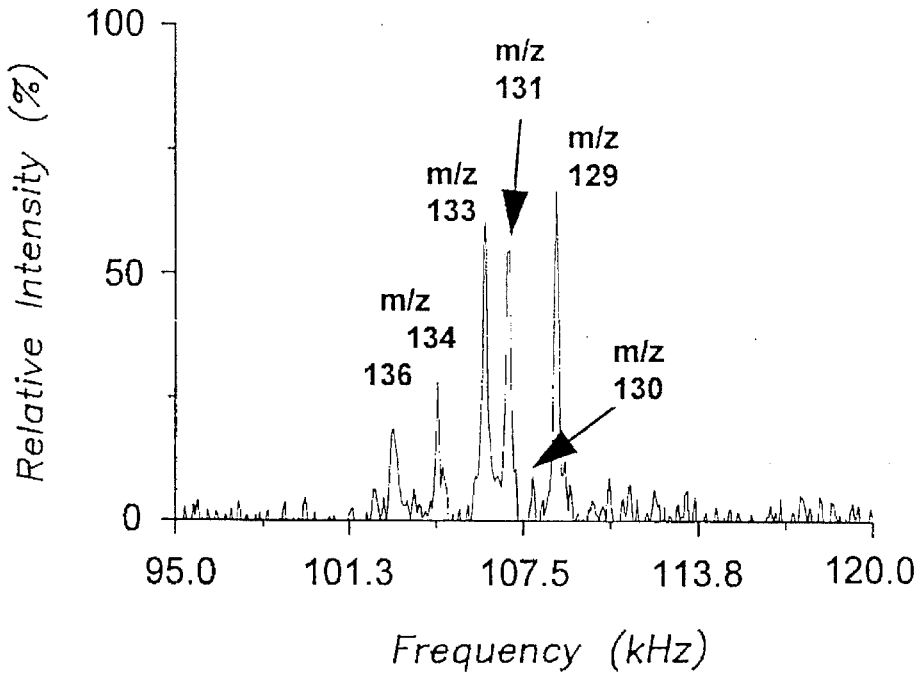
FIGS. 13A–B show a spectrum for xenon and a broadband spectrum of benzonitrile with dc pulse excitation.
Figure 13B:
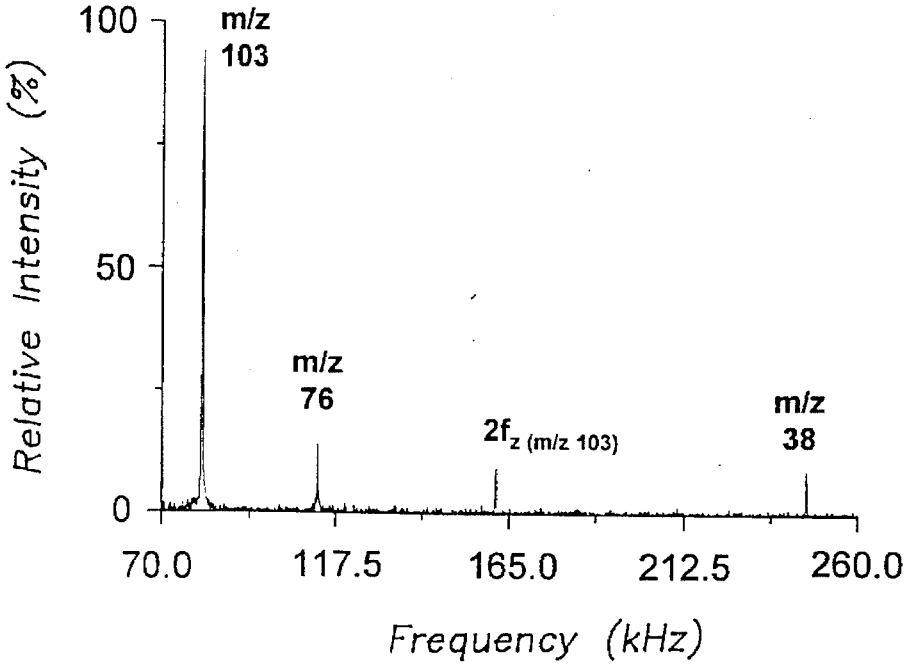
Figure 14:
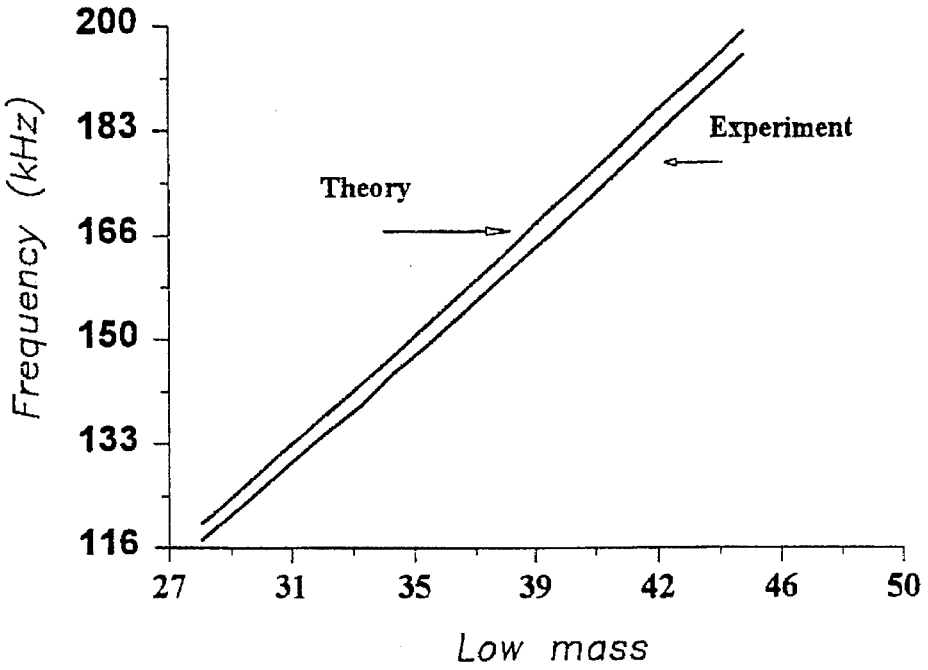
FIG. 14 shows the experimental and calculated ion frequency for m/z 40 ions generated from Argon when the Mathieu parameter (expressed as the low mass cut-off) is varied.
Figure 15:
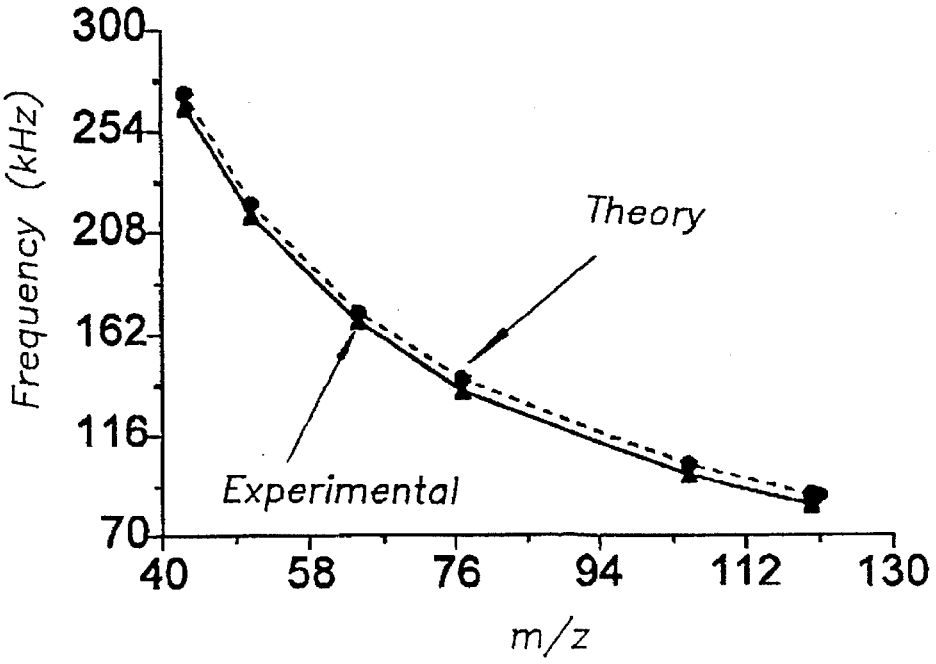
FIG. 15 shows the experimental and calculated ion frequencies for various ions generated from acetophenone under a given set of operating conditions.

DC pulse excitation and non-destructive detection experiments were carded out on xenon and benzonitrile with ionization time 0.9 ms, DC pulse 2 us, 50 volts, trap pressure $2\times10^{-6}$ torr for Xenon and with ionization time 0.8 ms, DC pulse 2 us, 13 volts, trap pressure $3\times10^{-6}$ torr. FIGS. 13A shows a partial spectrum of xenon and FIG. 13B a broadband spectrum of benzonitrile. The spectra display the expected peaks although some harmonics also occur.

From a large amount of data of the type shown in FIG. 13, correlations between the measured and calculated ion frequencies have been obtained. These important results suggest that automated routines for mass assignments can be developed for broad- and narrow-band non-destructive detection.

Figure 16:
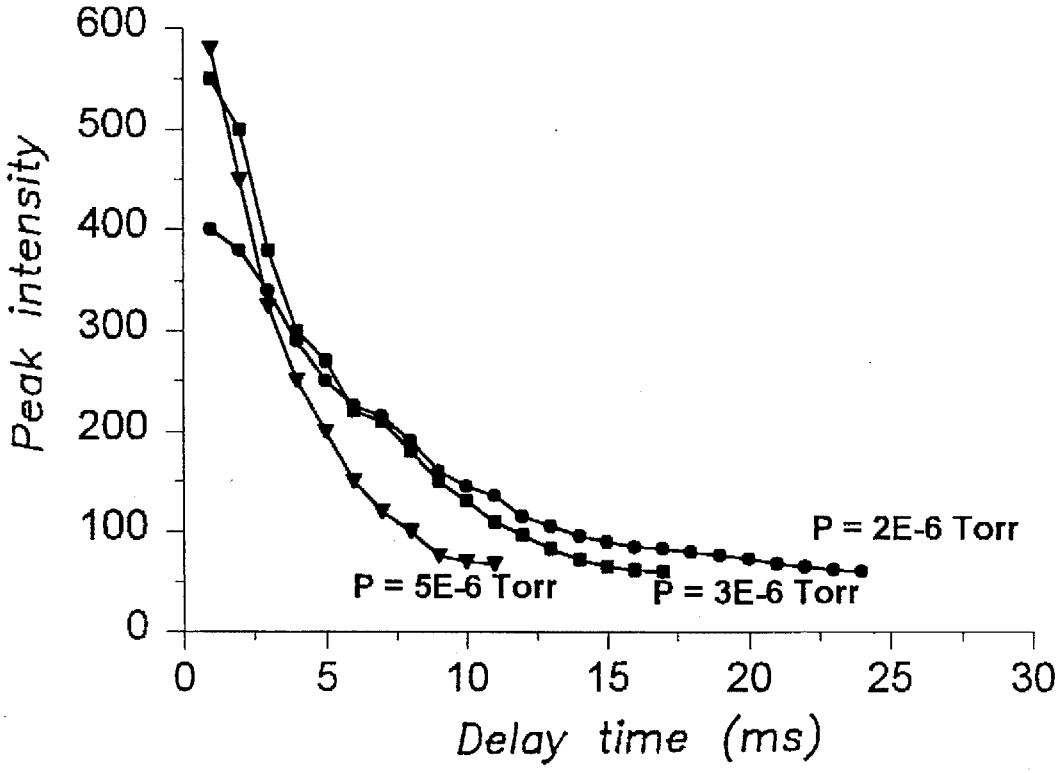
FIG. 16 shows the effect of sample pressure on the transient lifetime of ions.

The effect of sample pressure on transient lifetime of ions follows expectation, as shown in FIG. 16 and peak intensity as a function of delay time after excitation is shown for krypton (m/z 83.8), frequency 1834 Khz, DC pulse 2 mz, 5 volts is shown as a function of pressure.

Figure 17A:
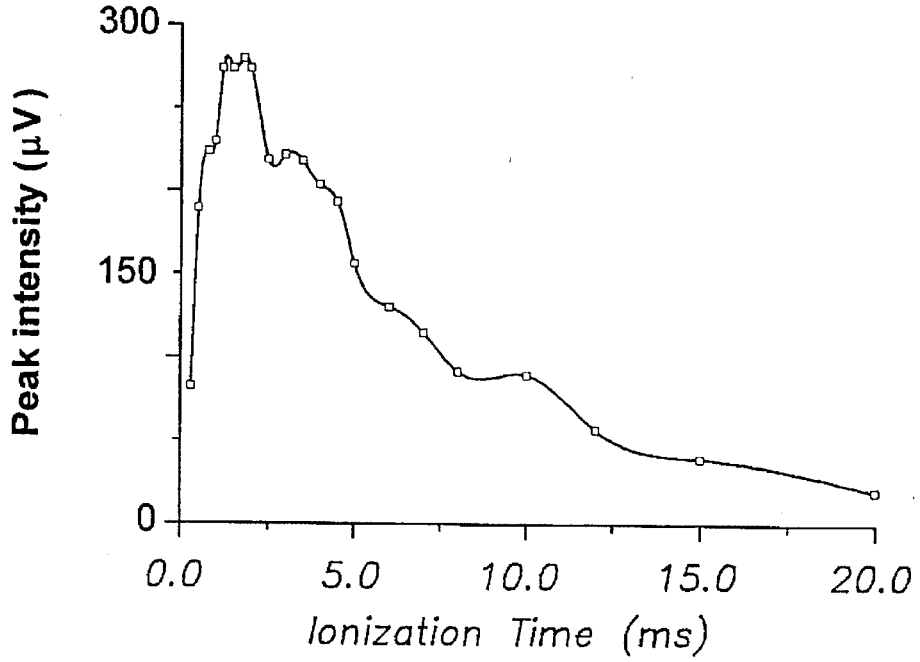
FIG. 17 shows the effect of space charge on peak intensity, position and width.
Figure 17B:
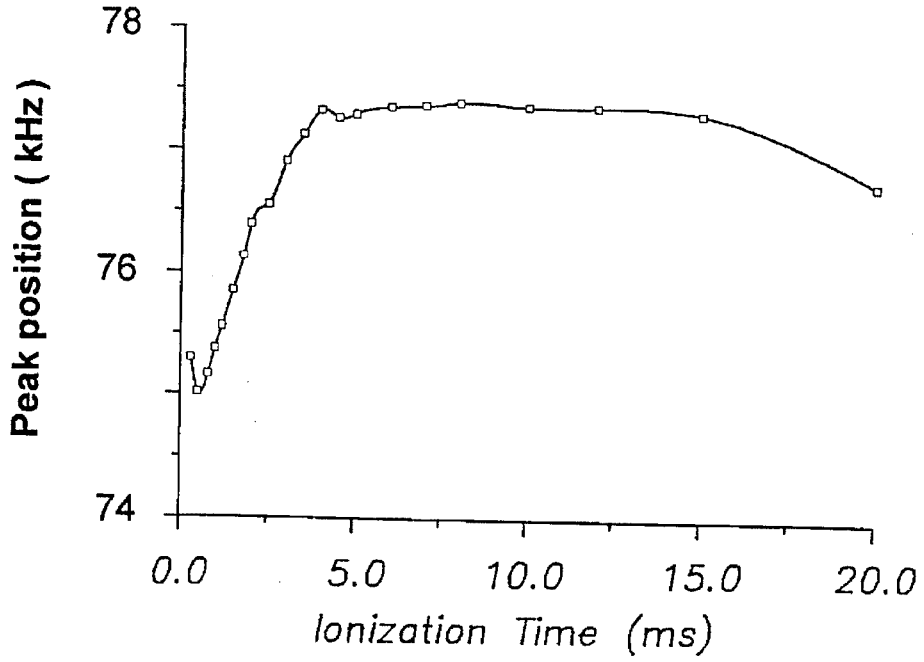
Figure 17C:
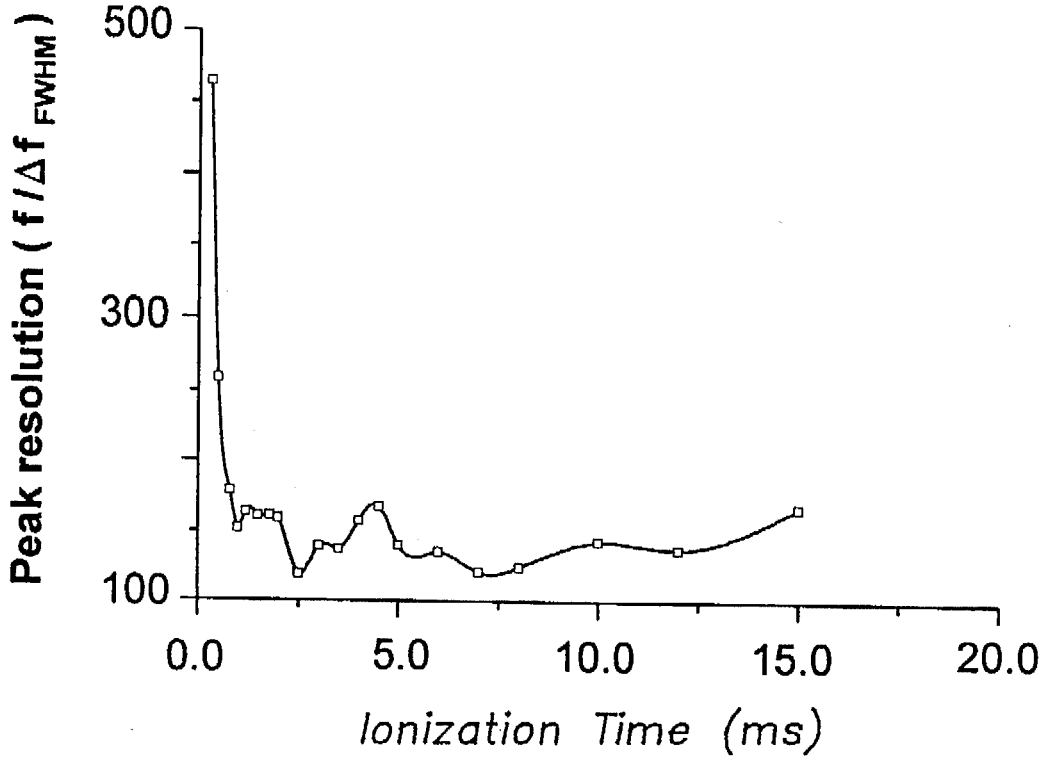

The effect of space charge, adjusted by altering the ionization time, on peak intensity (peak height), position and width is shown in FIGS. 17A–C for argon at $2\times10^{-6}$ Torr pressure when excited with a 5 v dc pulse for 2 μs.

Figure 18A:
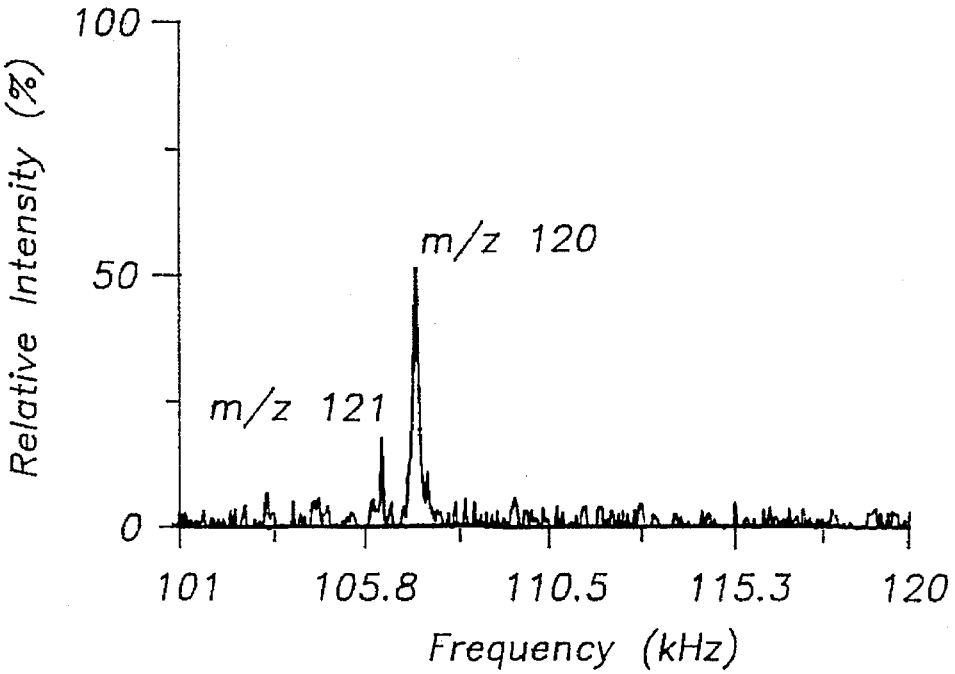
FIGS. 18A–B show the effect of sample pressure on ion/molecule reaction.
Figure 18B:
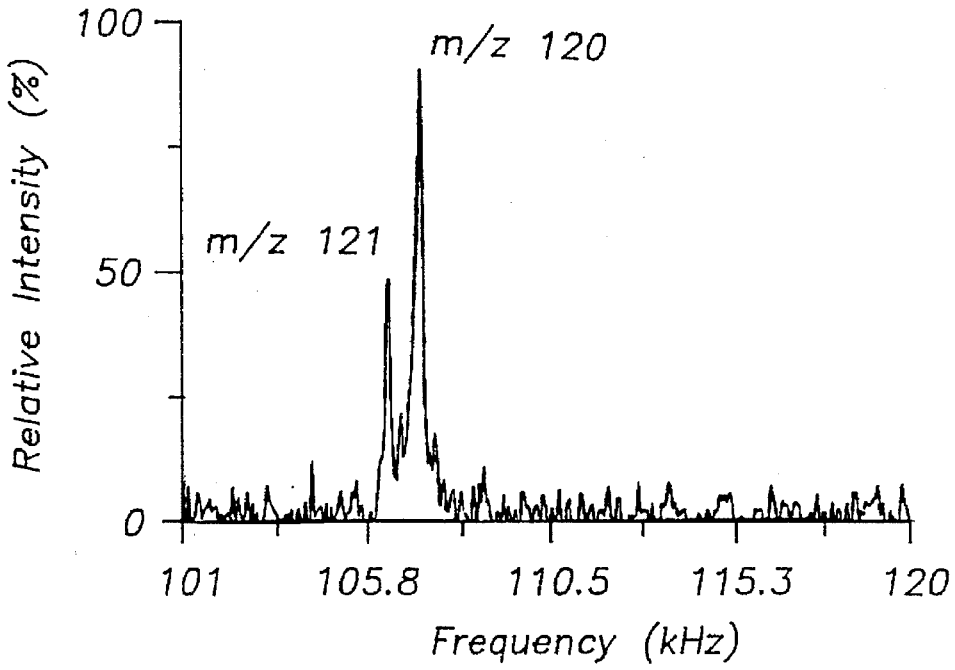

Ion/molecule reactions can also be followed using the DC pulse excitation procedure. FIGS. 18A–B shows the effect of increasing the sample pressure on the relative abundance of the acetophenone molecular ion, m/z 120 and the product of its ion/molecule reaction, the protonated molecule, m/z 121. The sample pressure was $1.4\times10^{-6}$ Torr and the excitation pulse was 30 v dc with 2 ms duration.

Because the signal strength depends on how closely the excited ion packet approaches the detector electrode, experiments were done in which the trap was biased so that the potential minimum in the z-(axial)-direction was located closer to the detector end-cap electrode than to the entrance end-cap. This was achieved by biasing the trap as shown in FIG. 19A. FIG. 19B shows how the field lines for the ion packet +Nq terminate on the electrode.

Figure 20A:
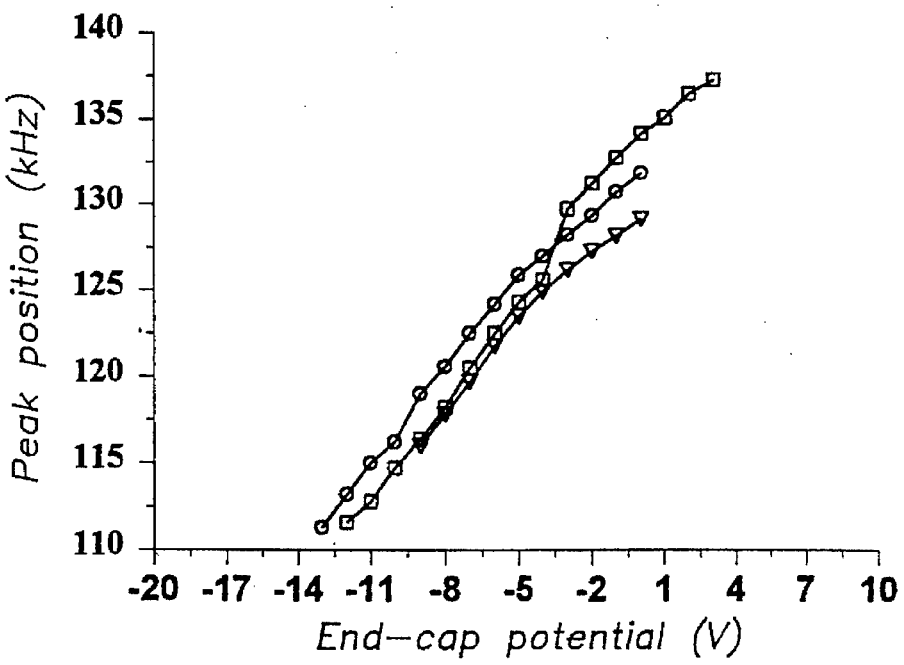
FIGS. 20A–B show the effect of operating the ion trap biased as shown in FIG. 19.
Figure 20B:
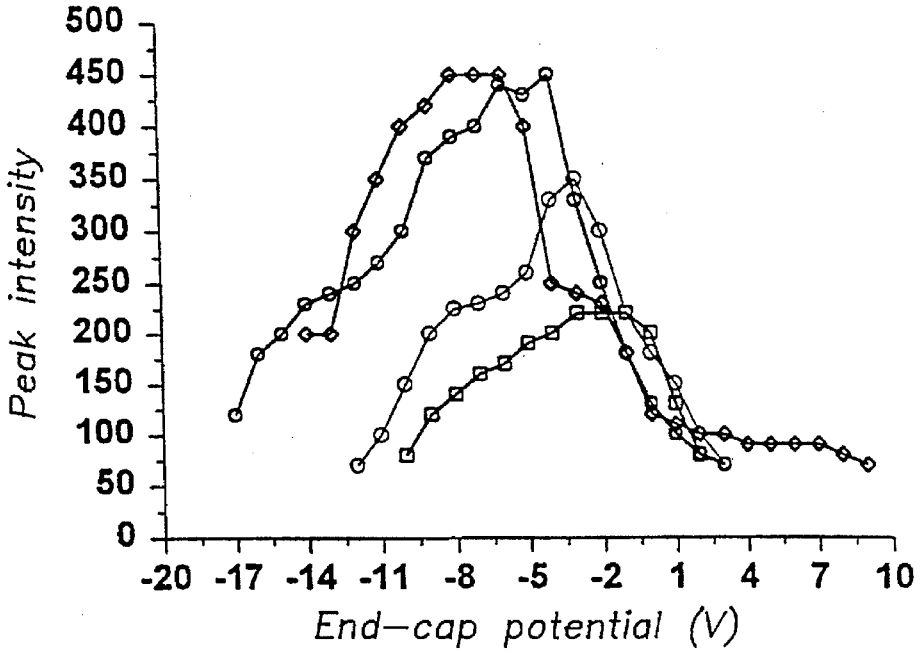

This mode of operation causes a strong effect of ion frequency on the potential of the detector electrode, as shown by the krypton data given in FIG. 20A. However, as shown in the figure, there is a substantial improvement in signal. FIG. 20A shows the relationship between peak position and end-cap electrode potential and FIG. 20B shows the increase in signal achieved with the bias. Data is for krypton ions, low mass cutoff m/z 30.

Figure 21:
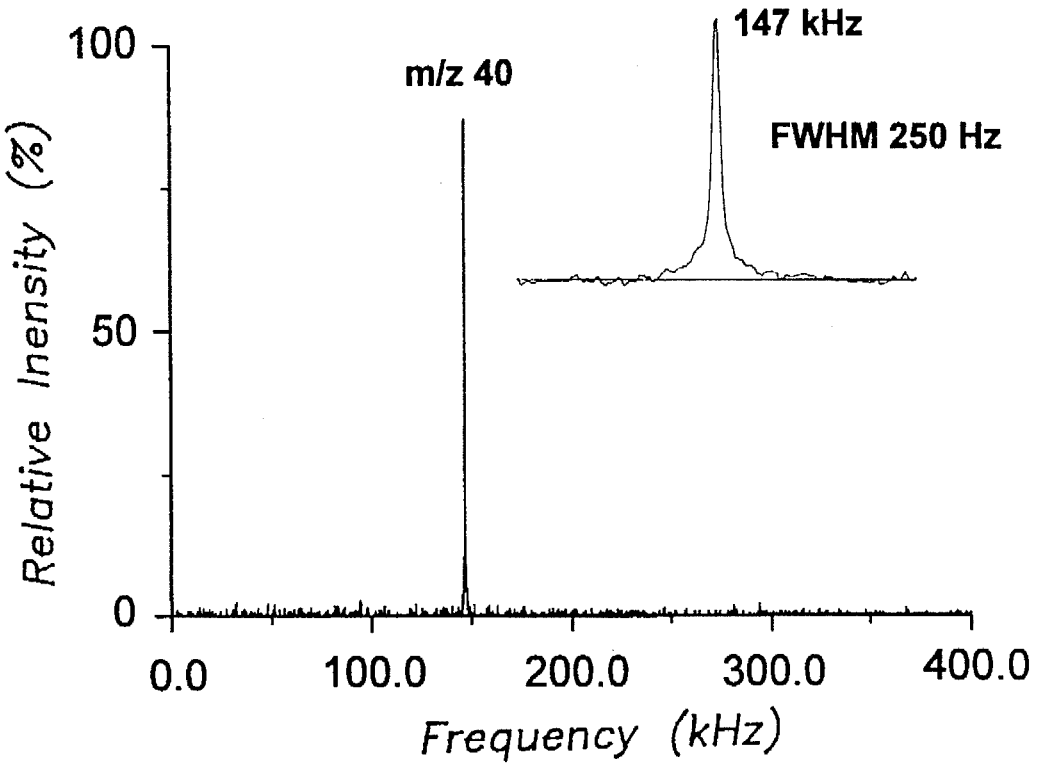
FIG. 21 shows the excitation of argon ions using a single swift pulse.
Figure 22A:
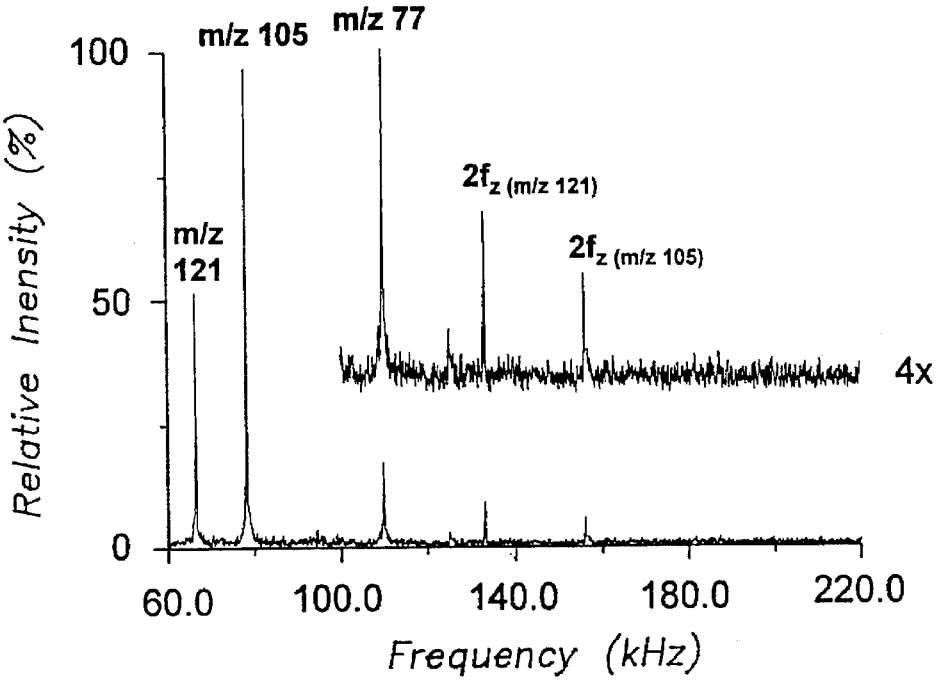
FIGS. 22A–D show the isolation of m/z 105 using two notched swift excitation pulses.
Figure 22B:
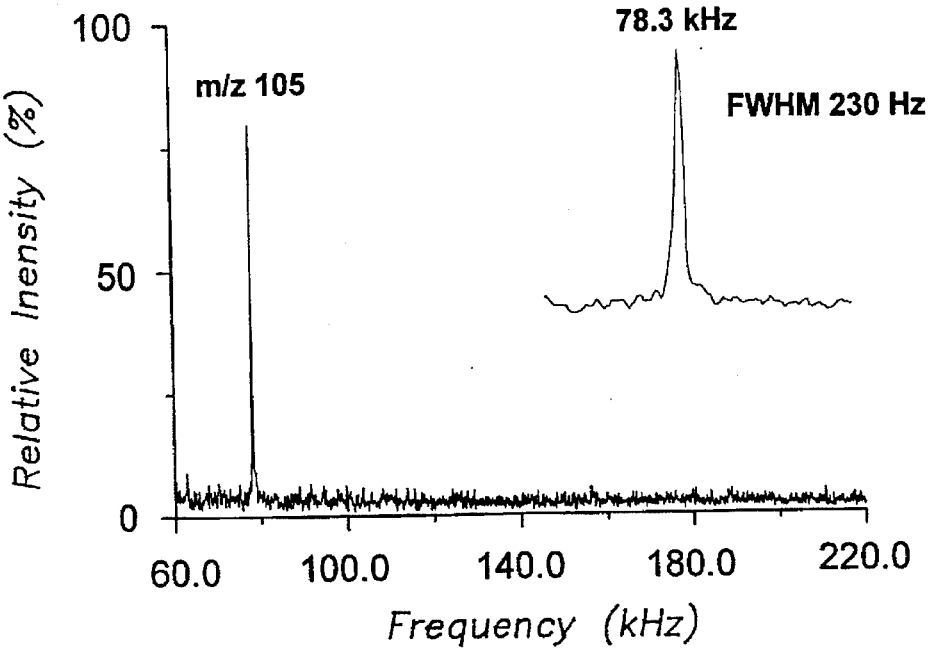
Figure 22C:
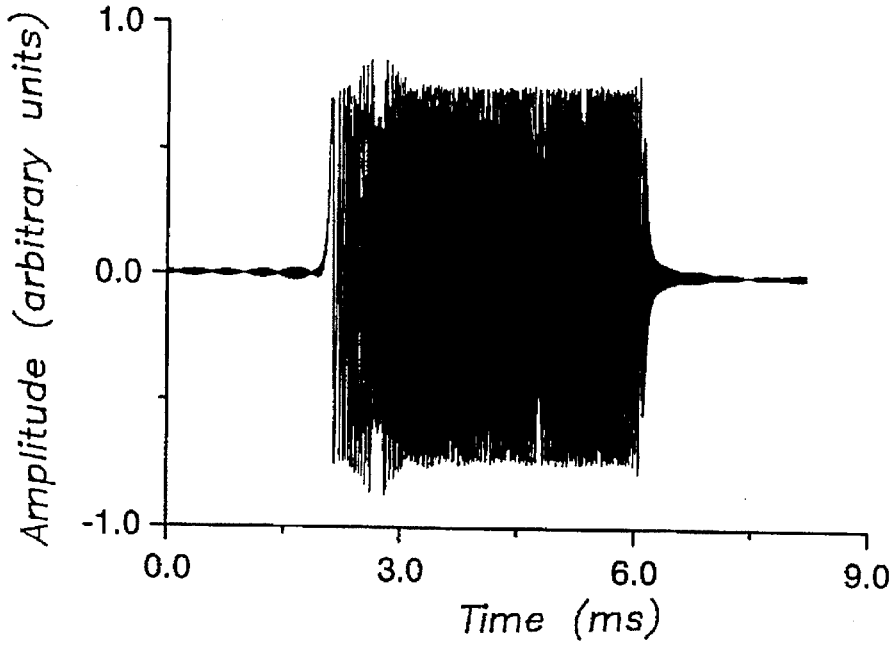
Figure 22D:
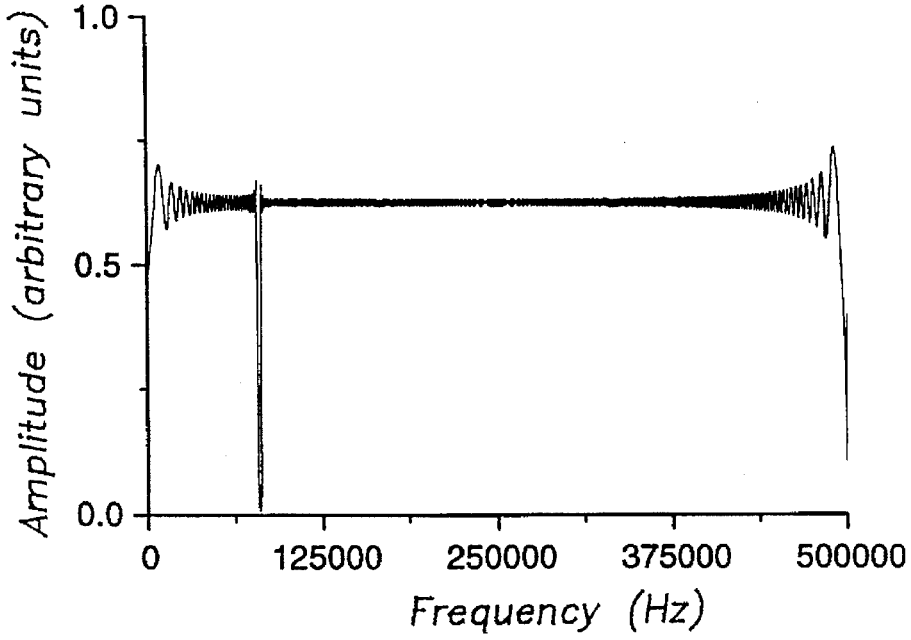

Stored waveform inverse Fourier transform (SWIFT) experiments in which selected waveforms were used either for ion isolation or for excitation were also performed. These SWIFT experiments were based on the procedures described by Marshall and coworkers and implemented using procedures described for ion trap instruments by Julian and Cooks and by Soni et al. FIG. 21 shows the quality of the non-destructive detection experiment when SWIFT was used to excite argon ions. A single SWIFT pulse covering the range 0–500k Hz, lasting 8.19 ms, and having amplitude 400 $mV_{0,p}$ was applied to excite the argon ions. Note that the peak width is only 240 Hz. FIGS. 22A–D shows a related experiment in which SWIFT is used for isolation of an ion prior to non-destructive detection. Isolation of m/z 105, a fragment ion in the acetophenone mass spectrum, using two notched SWIFT pulses is shown in FIG. 22. The 8.19 ms, 2 V, pulse covered 0–500k Hz and was notched at 80k Hz using a 2.44k Hz notch. FIG. 22A shows the original mass spectrum, FIG. 22B shows the isolated m/z 105 ion with width (FWHM) of 240 Khz and FIGS. 22C and 22D show the SWIFT pulse in the time and frequency domains.

Figure 23:
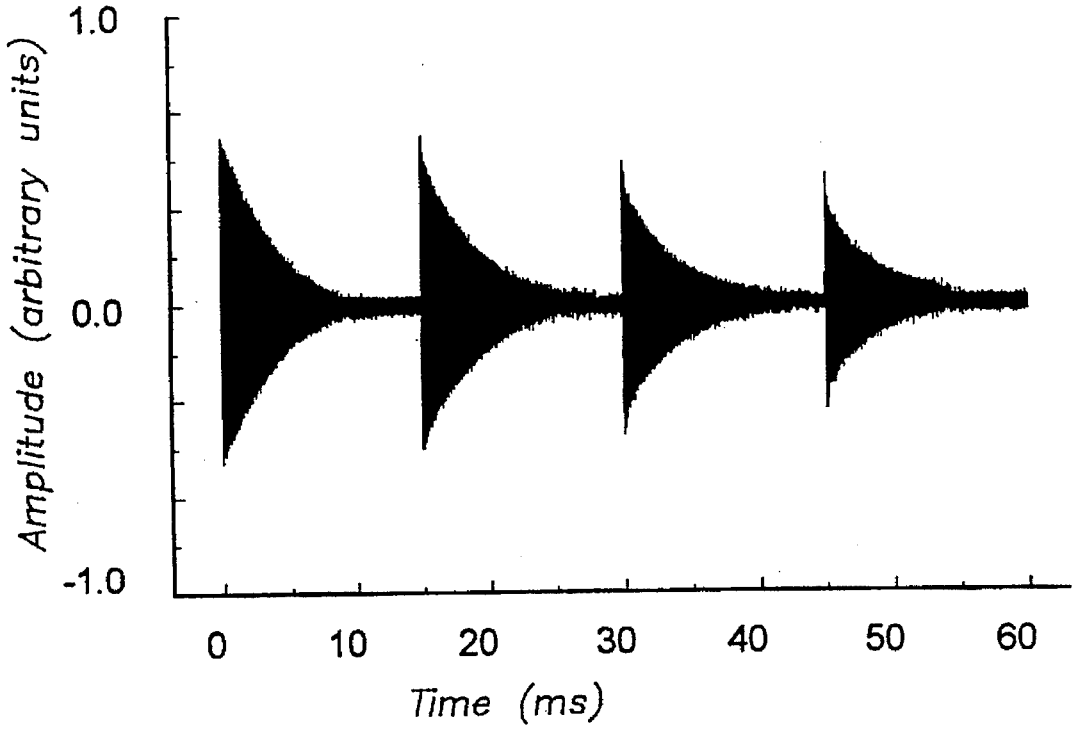
FIG. 23 shows the image current for successive excitation pulses.
Figure 24A:
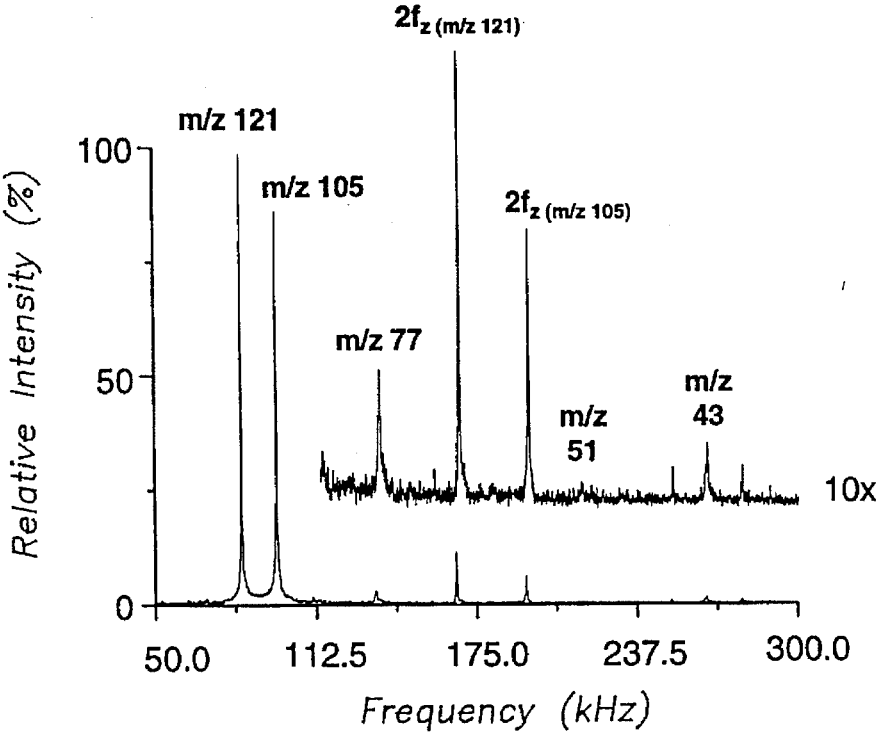
FIGS. 24A–B show the mass spectra for the first and second transients in the non-destructive detection of acetophenone.
Figure 24B:
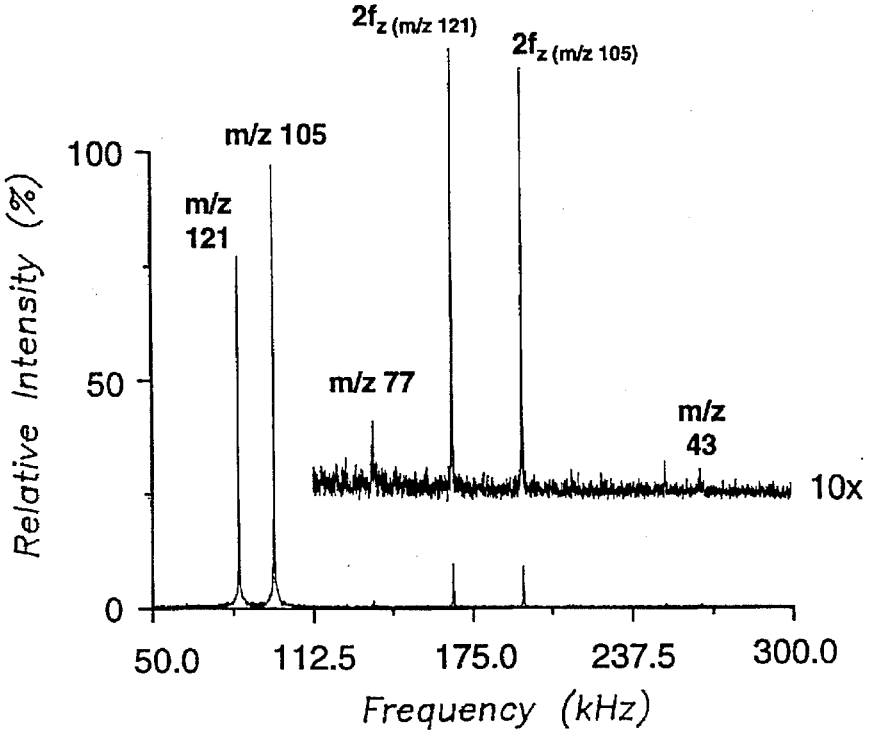

A key to high performance non-destructive detection using an ion trap mass spectrometer, is the ability to manipulate and remeasure ion populations. This capability has been demonstrated by applying successive DC excitation pulses to a population of ions after collisional dampening has occurred. FIG. 23 illustrates data for one such experiment in which argon ions were trapped using a low mass cutoff of m/z 20 and then excited using an 8 volt, 2 us, DC pulse. The population transient was recorded after 1 through 11 DC pulses and data for the first four pulses are shown in the figure. Note the loss in intensity and increased noise in successive pulses. The mass spectra associated with remeasurement are illustrated in FIG. 24 in the case of acetophenone. Accumulation of the first transient and Fourier transformation of the data using the program Statmost, gives the mass spectrum shown in part FIG. 24A whereas FIG. 24B shows the very similar spectrum recorded when the second transient is examined. The resolution obtained in these experiments is on the order of 1200.

Figure 25A:
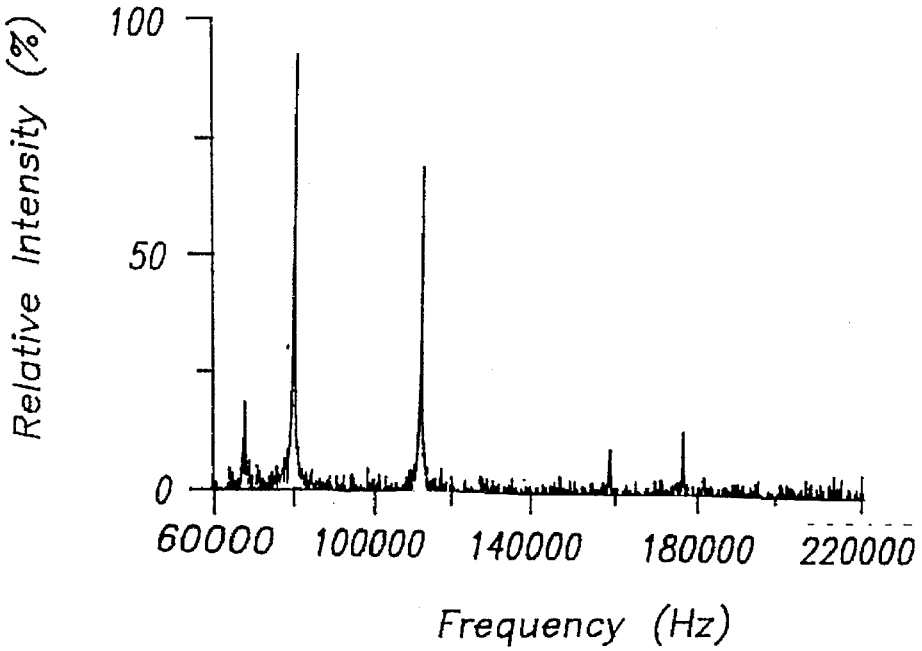
FIGS. 25A–C shows three detection steps of the non-destructive ms/ms analysis.
Figure 25B:
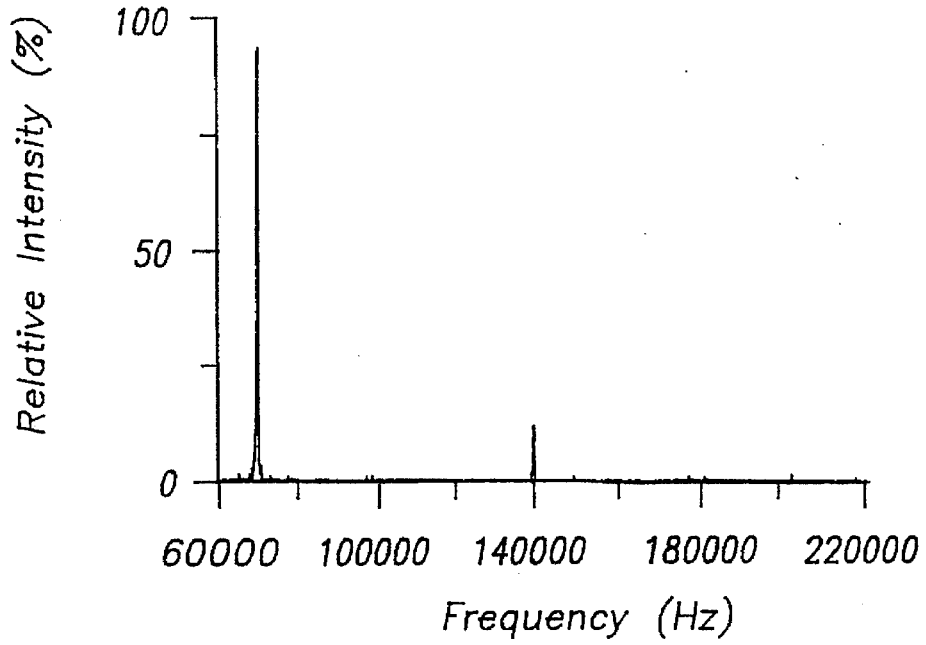
Figure 25C:
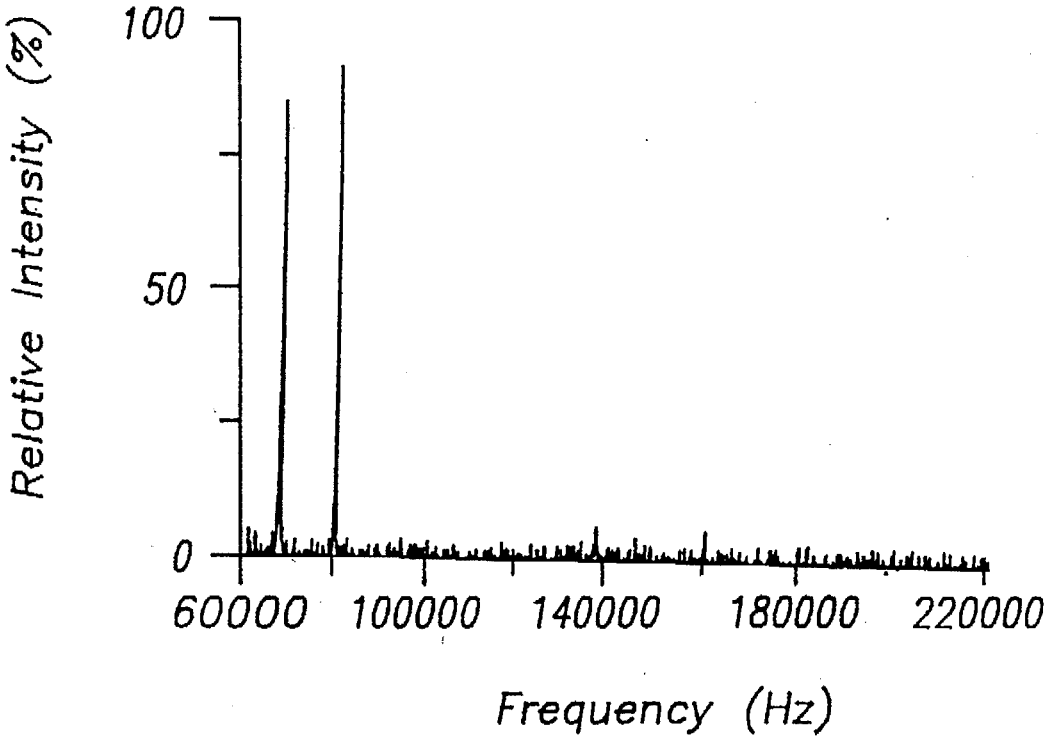

The non-destructive detection capability can be used in conjunction with conventional isolation and excitation methods to cause dissociation of mass-selected ions and to record the resulting MS/MS spectra. This capability is illustrated using RF amplitude adjustment for parent ion isolation and conventional dipolar AC excitation for collisional activation of a population of acetophenone ions. The experimental results are shown in the form of the FT's of three transients in FIG. 25. FIG. 25A shows the original ion population generated by electron ionization, FIG. 25B shows the mass-selected population, m/z 120, isolated by the RF scan method and FIG. 25C shows the MS/MS product ion spectrum of m/z 120, dissociated using gentle collision induced dissociation conditions using resonant excitation. Helium was added in order to facilitate CID in these experiments. The entire scan sequence consisted of the following steps: ionization, delay, DC excitation, transient detection to record mass spectrum, RF isolation of parent ions, DC excitation, transient detection to record parent ion population, resonant AC excitation of parent ions to cause dissociation, cooling of product ions, DC excitation, transient detection to record product ions. A single ion population was employed in the experiment.

Figure 1:
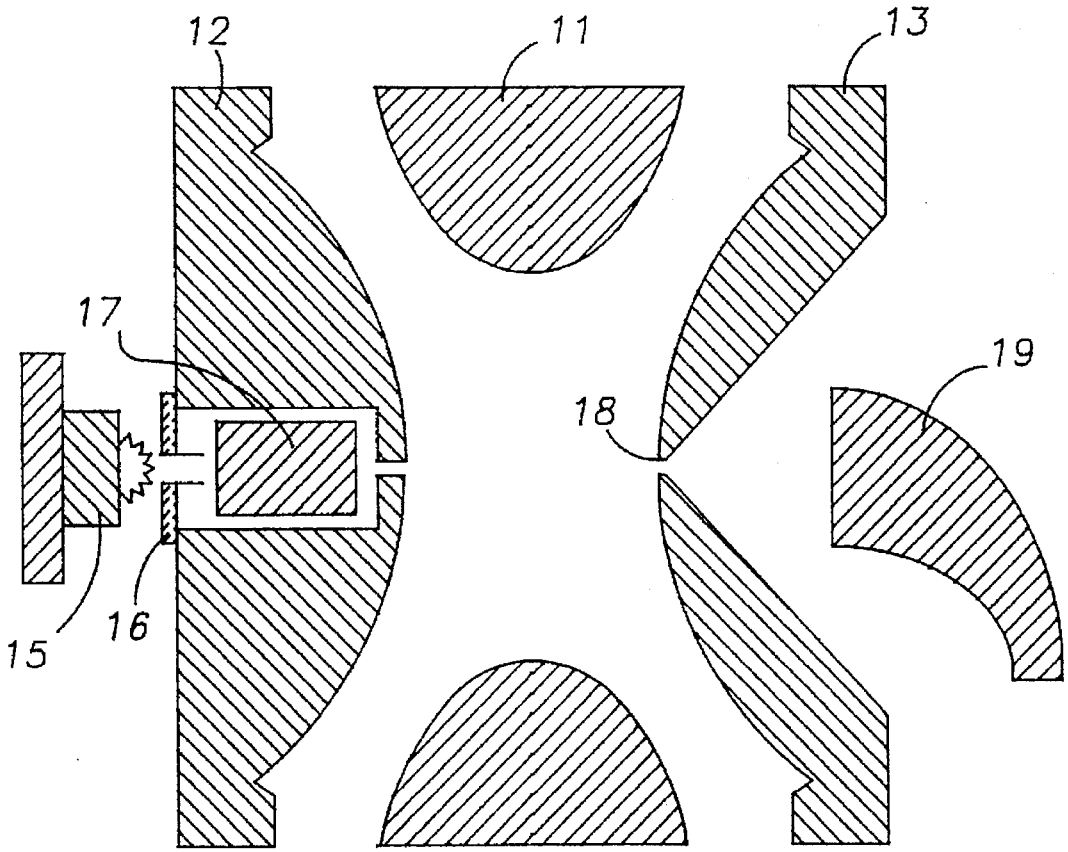
(PRIOR ART) FIG. — 1
FIG. 1 shows a three dimensional quadrupole ion trap in accordance with the prior art.
Figure 26:
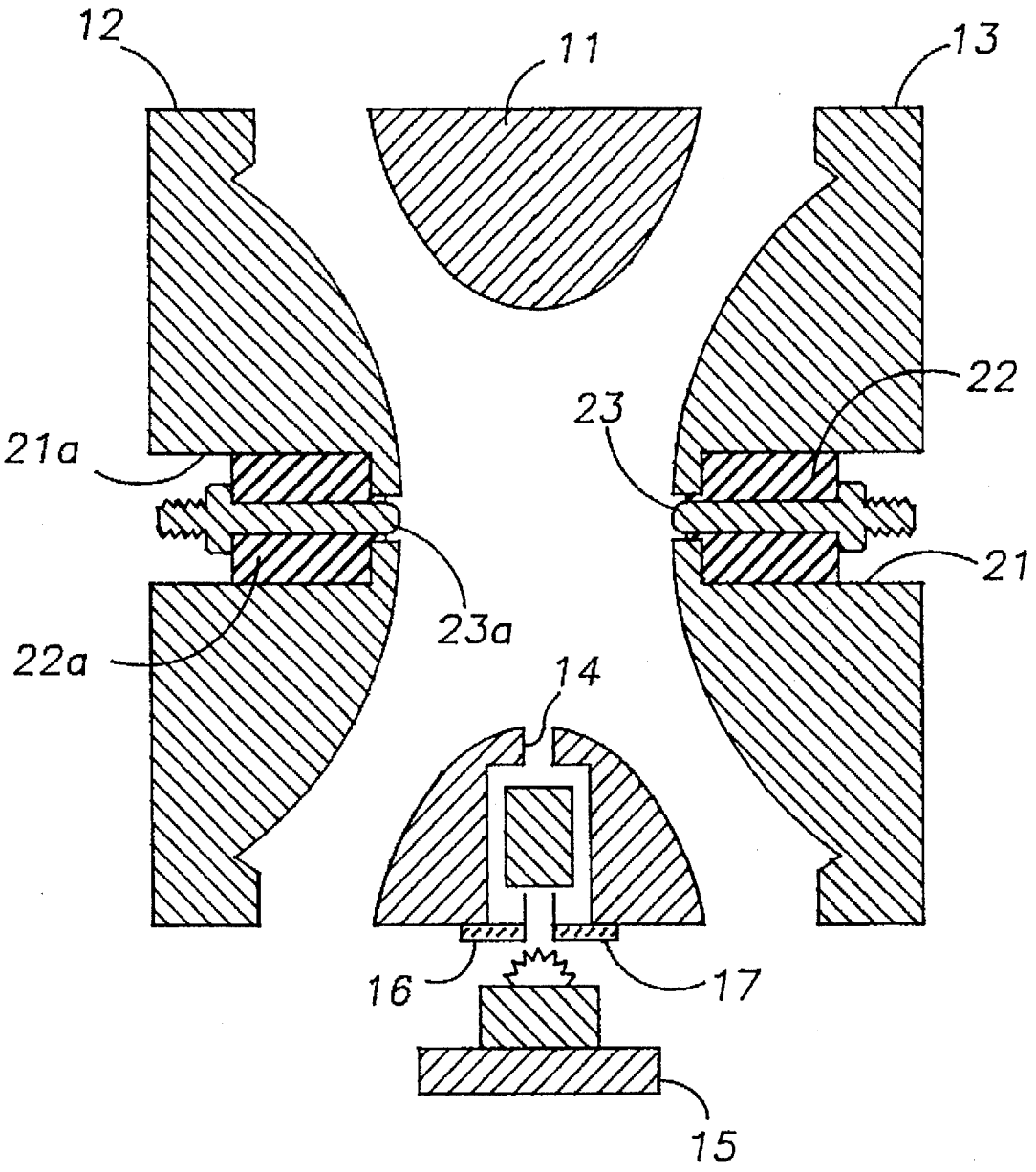
FIG. 26 shows an ion trap including a sensing electrode in each of the end caps.
Figure 27:
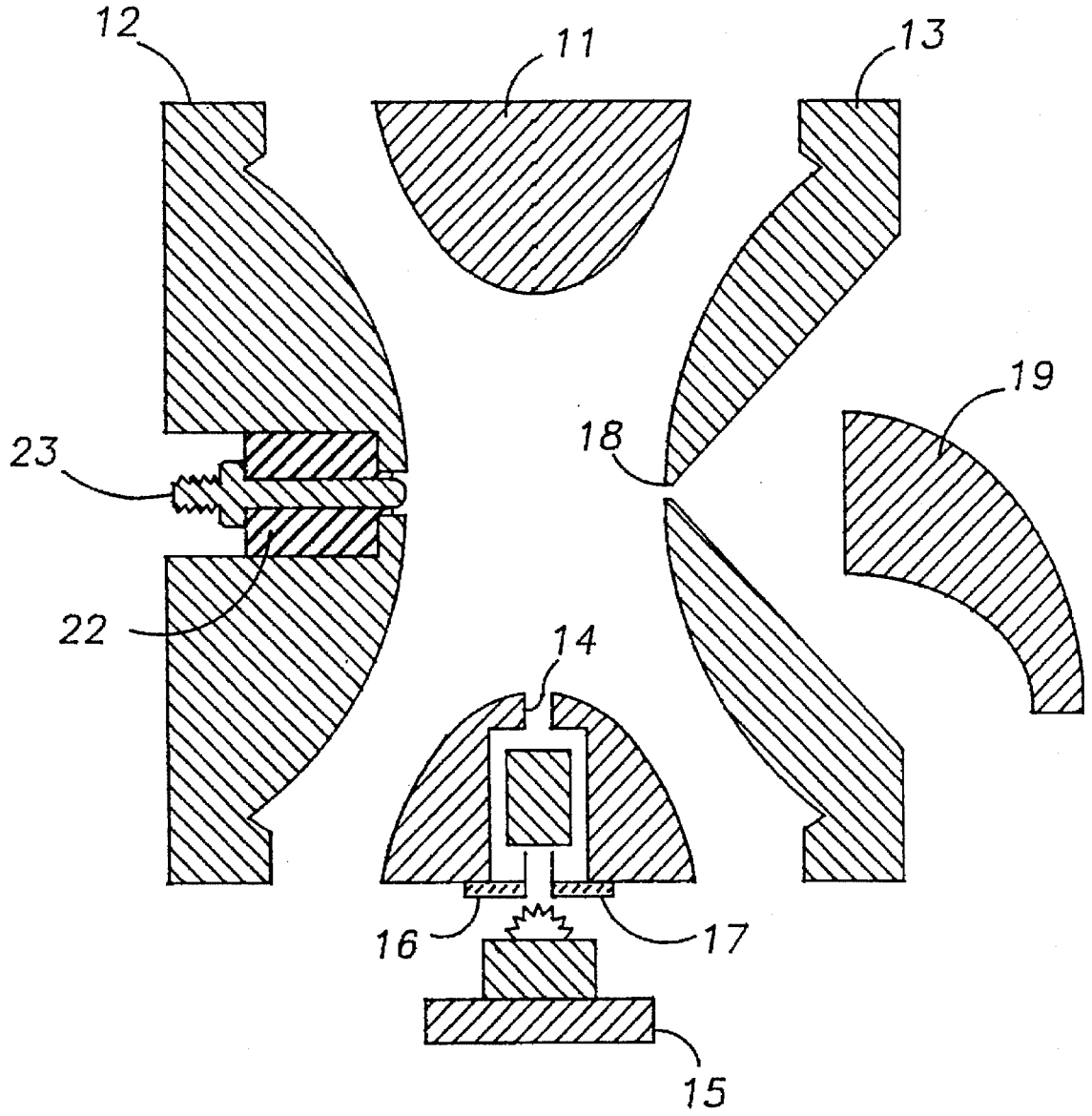
FIG. 27 shows an ion trap which can be operated in both the destructive and non-destructive mode.

FIG. 26 shows an ion trap which includes detector electrodes in each of the end caps. The reference numerals correspond to those of FIG. 2 for like parts. The image currents in the electrodes 23, 23A are added to double the sensitivity. FIG. 27 shows an ion trap which can be operated in the ion selective mode as in the prior art or in the non-destructive mode in accordance with the present invention. Like reference numerals have been applied to parts like found in FIGS. 1, 2 and 27.

Figure 28B:
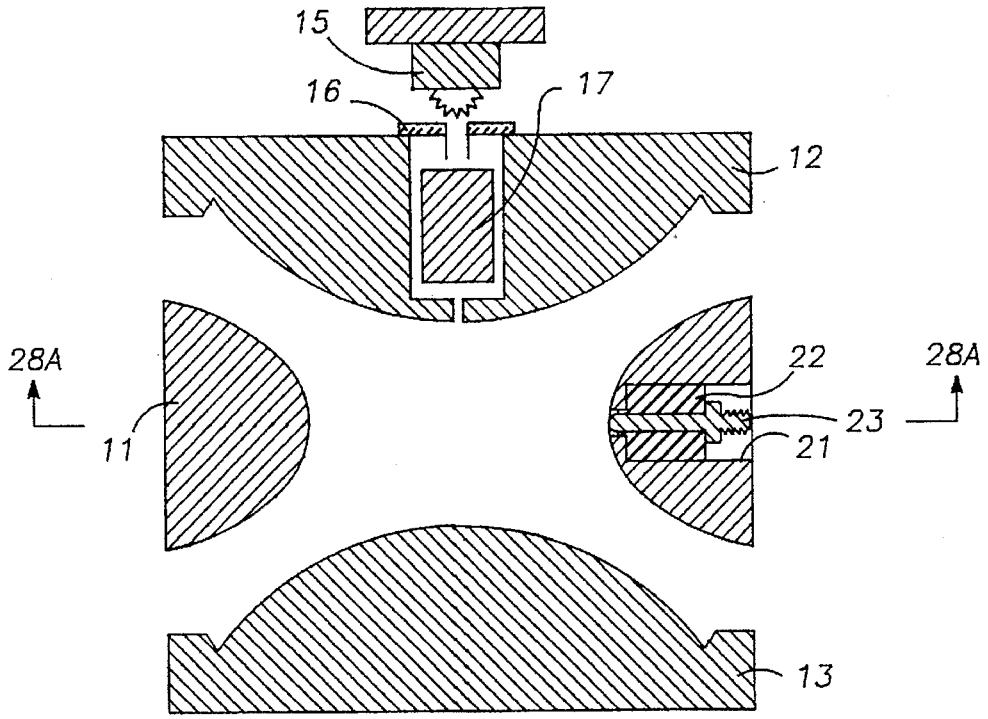
FIGS. 28A–B show an ion trap in which the sensing electrode is disposed in a section of the ring electrode.
Figure 28A:
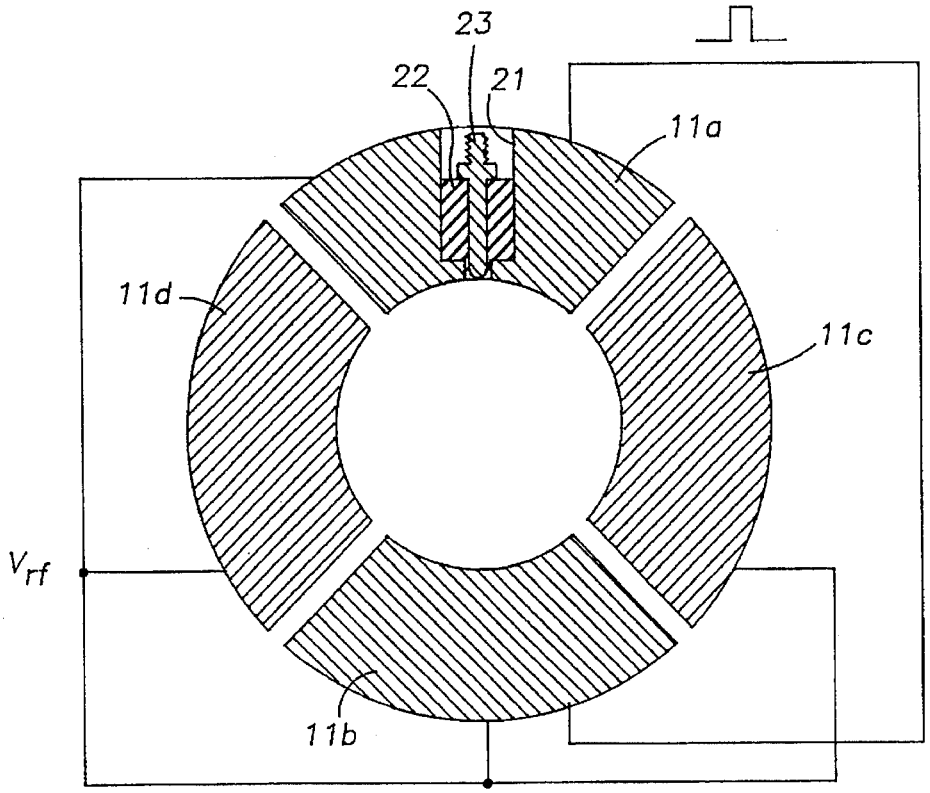

Rather than exciting the ions for oscillation in the axial direction by applying excitation pulses to one or both end caps and detecting the ions with detectors at one or both end caps, it is possible to excite ions in the radial direction by splitting the ring electrode and applying pulses to one section of the ring electrode and detecting the ions with one or more detectors at the ring electrode. FIGS. 28A and 28B show an ion trap in accordance with this embodiment of the invention. The ring electrode 11 is split into four sections. The rf voltage is applied to all of the sections to provide the trapping voltage. An excitation pulse is applied between the ring sections 11*a* and 11*b* to excite the ions in a radial direction. Detector electrode 23 is supported in the ring electrode by the insulating sleeve 22. Image currents are induced in the detector 23 by the radially excited ions.

What is claimed:

1. An ion trap mass spectrometer of the type having an ion trapping volume defined by a ring electrode and end cap electrodes in which ions over a predetermined mass-to-charge ratio can be trapped by the application of rf or rf and dc voltages to the electrodes characterized in that, at least one small independent image current electrode is associated with at least one of said ion trap electrodes, and said image current electrode generates image currents in response to movement of ions trapped in said trapping volume resulting from the application of an excitation voltage pulses to one of said electrodes which causes ions to move towards and away from said image current electrode whereby image currents electrode generates image currents.

2. An ion trap as in claim 1 in which said image current electrode extends through one end cap electrode to couple to ions in said ion volume.

3. An ion trap as in claim 1 in which an image current electrode extends through each end cap electrode to differentially detect ions' movement in said ion trap.

4. An ion trap as in claims 2 or 3 in which the excitation voltage is applied to at least one of the end caps.

5. An ion trap as in claim 1 in which the ring electrode is segmented and said at least one image current electrode extends through one of said segments and the excitation pulse is applied to at least one of said segments to cause ions to oscillate on the radial direction towards and away from said current sensing electrode.

6. An ion trap mass spectrometer as in claims 1, 2, 3, or 5 including means for processing said image currents to provide a frequency spectrum representing the ion trapped in said trapping volume.

7. An ion trap as in claims 1, 2, 3, or 5 including means for projecting an electron beam into said trapping volume to ionize sample introduced into said trapping volume.

8. The method of nondestructively analyzing a sample in an ion trap of the type having a trapping volume defined by a ring electrode and end cap electrodes which comprises the steps of introducing ions of the sample into said trapping volume or creating sample ions in said volume;

trapping the sample ions in said trapping volume by applying an rf, or rf and dc voltages, to said ring and cap electrodes, applying an electrical excitation pulse to at least one of said ion trap electrodes to cause the trapped ions to oscillate in a predetermined direction, and positioning a small image current electrode in said ion trap to record image currents in response to the movement of ions towards and away from said image current electrode.

9. The method of claim 8 including the step of analyzing said image currents to provide a frequency spectrum of the sample ions trapped in said trapping volume.

10. The method of claims 8 or 9 in which the image current electrode is positioned at one of the end cap electrodes and the electrical excitation pulse is applied to an end cap to cause the ions to oscillate between the end caps.

11. The method of claims 8 or 9 which includes allowing the excited ions to reach equilibrium and then again applying an excitation pulse and detecting the image currents, and averaging or summing the image currents or frequency spectrum for repeated excitations.

12. The method of claims 8 or 9 in which the excitation pulse is tailored to only excite ions of predetermined masses.

13. The method of claims 8 or 9 in which a de field is applied to one of the electrodes to bring the oscillating ions closer to the image current sensing electrode.

14. The method of claims 8 or 9 in which the sensing electrode is moved to a position which optimizes the image currents.

15. An ion trap mass spectrometer comprising a quadrupole structure including spaced end caps and a ring electrode;

means for applying an rf voltage between the ring electrode and at least one of said end caps to form a three-dimensional trapping field;

excitation pulse means for applying an excitation pulse to at least one of said electrodes to cause characteristic motions of ions trapped in said trapping volume; and a small detector electrode positioned to detect the characteristic motion of said excited ions and provide an image current.

16. An ion trap mass spectrometer as in claim 15 including means for receiving said image current and processing the image current to provide a frequency spectrum of the trapped ions.

17. An ion trap mass spectrometer as in claim 16 in which said processing means includes a high gain amplifier and a filter for filtering out any rf signal picked up by the small detector electrode.

18. An ion trap mass spectrometer as in claim 15 including a small detector electrode positioned at each of said end caps for detecting the characteristic motion of the ions.

19. An ion trap mass spectrometer as in claim 15 in which the ring electrode is segmented and the excitation pulse is applied to selected segments of the ring electrode to cause characteristic motion in the radial direction.

20. An ion trap mass spectrometer as in claim 15 in which the excitation pulses are applied to at least one of the image current electrodes end caps to cause characteristic motion of the ions in the axial direction.

* * * * *

UNITED STATES PATENT AND TRADEMARK OFFICE

CERTIFICATE OF CORRECTION

PATENT NO. : 5,625,186

DATED : April 29, 1997

INVENTOR(S) : Frankevich et al.

It is certified that error appears in the above-identified patent and that said Letters Patent is hereby corrected as shown below:

Column 1, line 3, after the title insert the following:

--STATEMENT AS TO RIGHTS TO INVENTIONS MADE UNDER FEDERALLY-SPONSORED RESEARCH AND DEVELOPMENT

The research from which this invention emanated was supported wholly or partly by the United States Government under Department of Energy Contract No. DE-FG02-94ER14470. The U.S. federal government may have rights in and to this invention.--

Signed and Sealed this

Twenty-sixth Day of January, 1999

*Attest:*

*Attesting Officer*

*Acting Commissioner of Patents and Trademarks*